US009797156B2

(12) United States Patent
Neumann et al.

(10) Patent No.: US 9,797,156 B2
(45) Date of Patent: Oct. 24, 2017

(54) RETRACTABLE ENCLOSURE

(71) Applicant: CHAMELEON TRANSPORTATION SYSTEMS INC., Pointe-Claire (CA)

(72) Inventors: Dietmar Neumann, Saguenay (CA); Adrian Radulescu, Pointe-Claire (CA)

(73) Assignee: CHAMELEON TRANSPORTATION SYSTEMS INC., Pointe-Claire, Quebec (CA)

( * ) Notice: Subject to any disclaimer, the term of this patent is extended or adjusted under 35 U.S.C. 154(b) by 0 days.

(21) Appl. No.: 14/426,297

(22) PCT Filed: Sep. 4, 2013

(86) PCT No.: PCT/CA2013/000758
§ 371 (c)(1),
(2) Date: Mar. 5, 2015

(87) PCT Pub. No.: WO2014/036635
PCT Pub. Date: Mar. 13, 2014

(65) Prior Publication Data

US 2015/0233139 A1 Aug. 20, 2015

Related U.S. Application Data

(60) Provisional application No. 61/697,068, filed on Sep. 5, 2012.

(51) Int. Cl.
*E04H 15/48* (2006.01)
*E04H 15/18* (2006.01)
*E04H 15/64* (2006.01)

(52) U.S. Cl.
CPC ..... *E04H 15/48* (2013.01); *E04H 15/18* (2013.01); *E04H 15/644* (2013.01)

(58) Field of Classification Search
CPC ..... E04H 15/18; E04H 15/48; E04H 15/644
(Continued)

(56) References Cited

U.S. PATENT DOCUMENTS 3,361,144 A * 1/1968 Folkes ..... 135/129
3,424,179 A * 1/1969 Minot ..... 135/129
(Continued)

FOREIGN PATENT DOCUMENTS

| | | |
|---|---|---|
| CA | 2637814 | 9/2008 |
| JP | 3921471 | 5/2007 |
| WO | 2010003515 | 1/2010 |

OTHER PUBLICATIONS

Giulio Barbieri S.R.L, "Ready Box 2" Technical drawings, Italy, 2010.

(Continued)

*Primary Examiner* — Noah Chandler Hawk
(74) *Attorney, Agent, or Firm* — Norton Rose Fulbright Canada LLP

(57) ABSTRACT

A retractable enclosure includes at least two displaceable structural bow frames which each define a roof section and opposed upwardly extending side sections. These sections are interconnected by joint connectors. The sections are also formed of extruded profiled straight metal tubes which have extruded interconnection channels. The tarp sections of flexible material are engaged by channels of some of the bow frames and collapse and expand as the bow frames are displaced closer or away from one another. Access to the enclosure can be provided from all sides thereof for access to its interior.

32 Claims, 18 Drawing Sheets

(58) Field of Classification Search
USPC ..... 135/129, 122, 121, 119, 906; 52/63, 222
See application file for complete search history.

(56) References Cited

U.S. PATENT DOCUMENTS

| | | | | | |
|---|---|---|---|---|---|
| 4,028,861 | A * | 6/1977 | Huddle | 52/745.08 | |
| 4,644,706 | A * | 2/1987 | Stafford et al. | 52/63 | |
| 4,649,947 | A * | 3/1987 | Tury et al. | 135/97 | |
| 4,667,692 | A | 5/1987 | Tury et al. | | |
| 4,683,686 | A * | 8/1987 | Ozdemir | 52/64 | |
| 4,841,688 | A * | 6/1989 | Rinaldi | 52/63 | |
| 4,844,109 | A * | 7/1989 | Navarro | E04H 15/505 | 135/129 |
| 5,181,352 | A * | 1/1993 | Friedman | 52/58 | |
| 5,269,106 | A * | 12/1993 | Stafford et al. | 52/63 | |
| 5,546,972 | A | 8/1996 | Wardell et al. | | |
| 6,109,283 | A * | 8/2000 | Burke et al. | 135/129 | |
| 7,389,785 | B2 * | 6/2008 | Loudermilk et al. | 135/121 | |
| 7,849,639 | B2 * | 12/2010 | Sprung | 52/82 | |
| 7,971,597 | B2 * | 7/2011 | Reyen et al. | 135/122 | |
| 8,136,306 | B2 | 3/2012 | Scheps | | |
| 2017/0001733 | A1 * | 1/2017 | Larson | B64F 1/30 | |

OTHER PUBLICATIONS

Giulio Barbieri S.R.L,"Ready Box 2", Assembling system, Italy, 2010.

Giulio Barbieri S.R.L.,"Retractable tunnels", Italy, 2010.

Giulio Barbieri S.R.L., "Ready Box 2" Tunnel, http://en.giuliobarbieri.iUproducts/folding-garage-football-tunnel-walkway-temporary-warehouse-ready-box/ready-box-2.

* cited by examiner

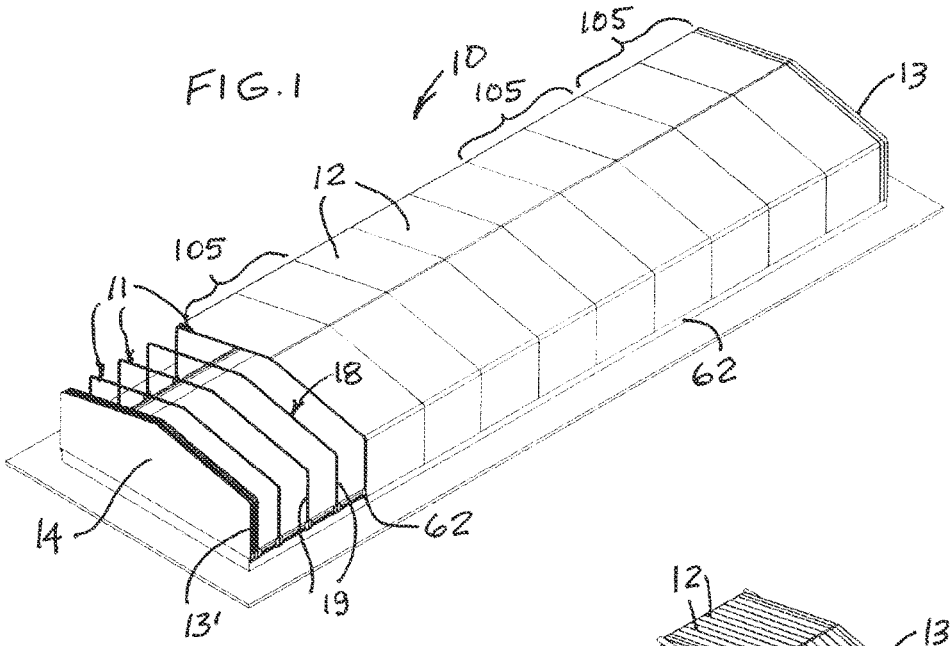
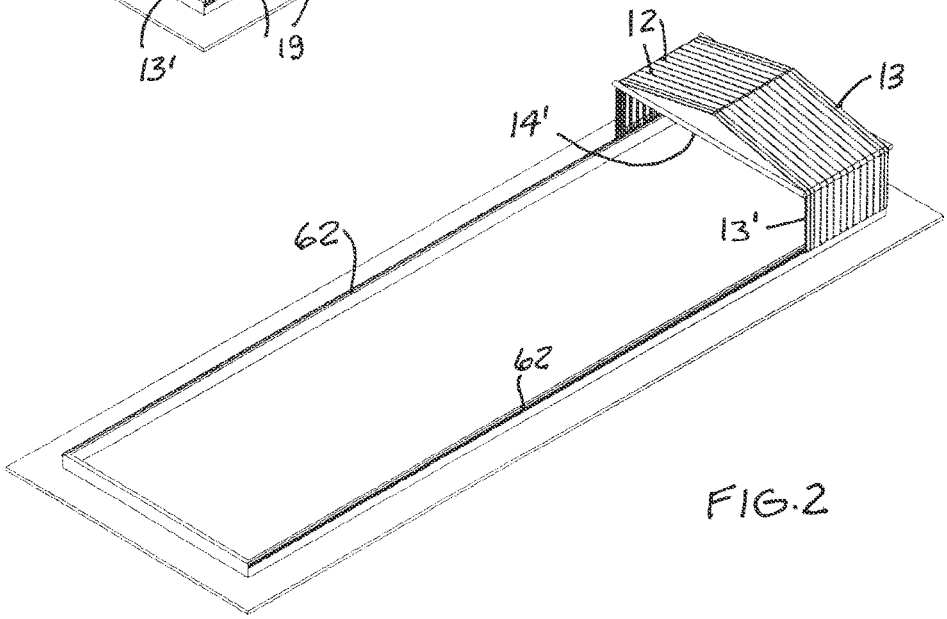
FIG. 2

FIG. 15D
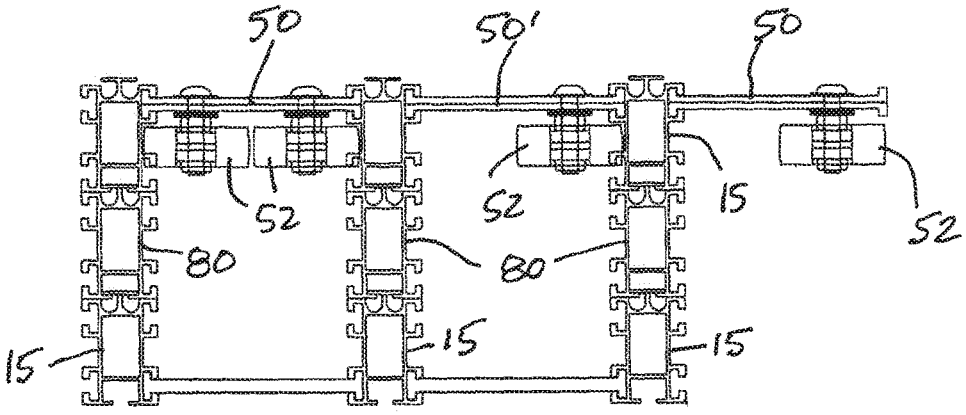
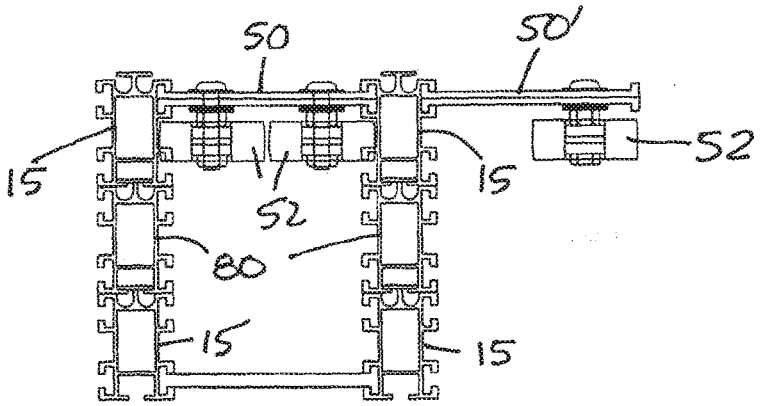
FIG. 15C

FIG. 16
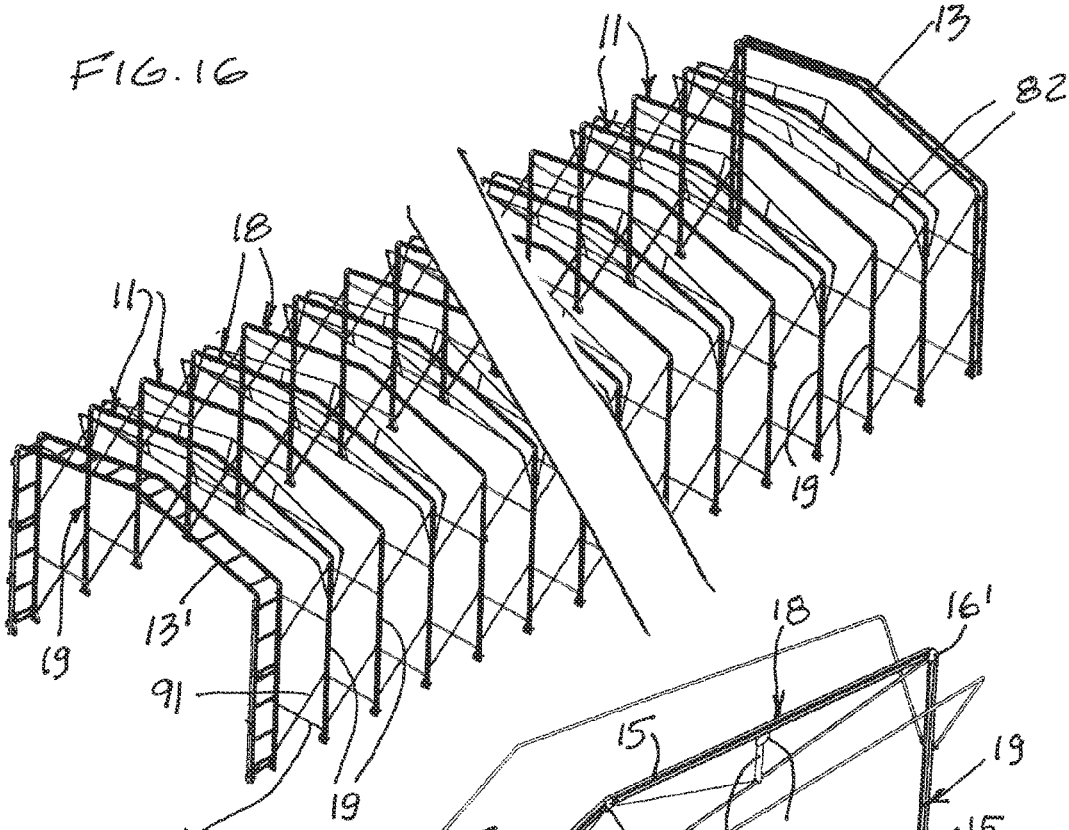
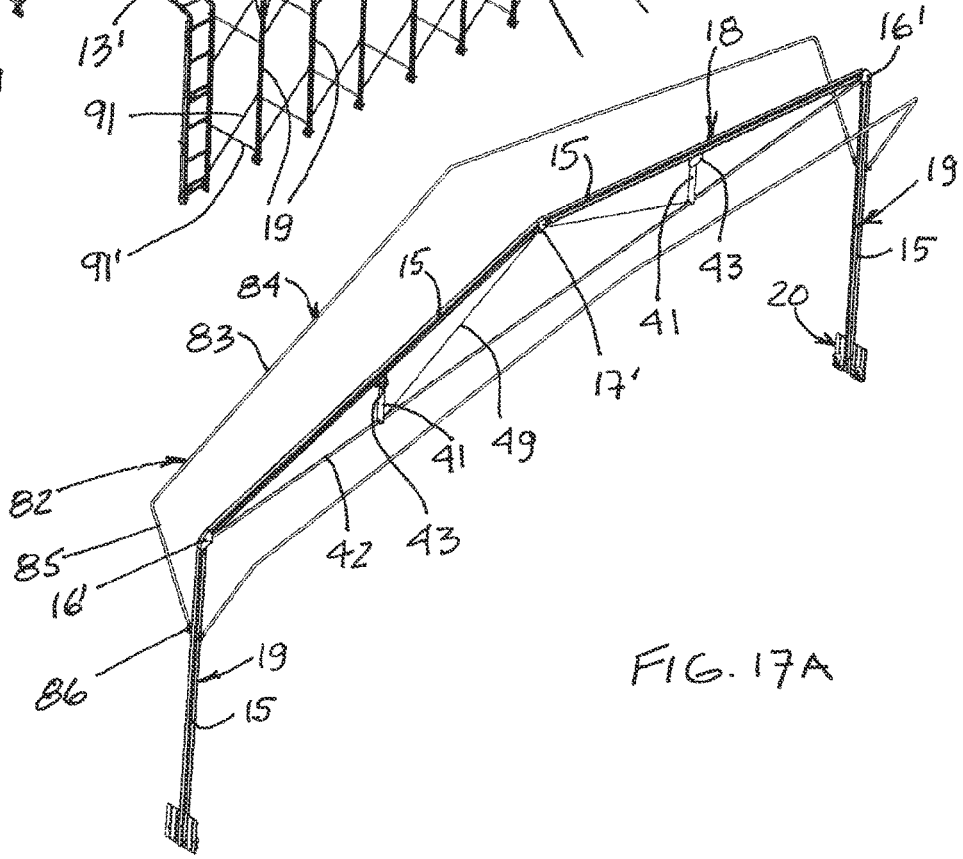
FIG. 17A

RETRACTABLE ENCLOSURE

CROSS-REFERENCE TO RELATED APPLICATIONS

The present application claims priority on U.S. provisional patent application No. 61/697,068 filed Sep. 5, 2012, the entirety of which is incorporated by reference herein.

TECHNICAL FIELD

The present invention relates to retractable enclosures and more specifically to an enclosure which is comprised of displaceable structural bow frames to which is engaged flexible tarp sections. The bow frames are displaceable towards or away from one another and are fabricated from straight extruded profiled tubes interconnected by joint connections.

BACKGROUND OF THE INVENTION

It is known in the prior art to provide retractable enclosures, such as to define a retractable enclosure on flat bed of road vehicles, to cover transported goods and to provide access to these goods from the back or sides of the retractable enclosure. Such retractable enclosures are comprised of a plurality of inverted U-shaped bow assemblies that support a shell which is usually formed by flexible tarp material. When retracted, the bow frames group together to make a compact package to provide access to contents. Reference is made to U.S. Pat. No. 7,445,265, the entirety of which is incorporated by reference herein, which discloses a retractable enclosure assembly for access to the cargo space of a transport vehicle. These assemblies include many interconnected parts and are usually constructed of hollow metal tubes.

BRIEF SUMMARY OF THE INVENTION

It is a feature of the present invention to provide a retractable enclosure which utilizes displaceable structural bow frames to which is connectedly supported tarp sections and which is particularly used to form a structure for storing goods or to provide a working environment which is protected from weather conditions and wherein the enclosure may be erected for outdoors as well as indoor use.

Another feature of the present invention is to provide a retractable enclosure comprised of displaceable structural bow frames and wherein the structure can be manufactured in a reduced period of time due to its use of a common extruded profiled straight metal tubes having only two interconnecting joint profiles. This permits to interlock multiple tube setups which reinforce both frames to construct different variance of bow frames for different load requirements. Such combination can be multiplied to accomplish any load requirements.

Another feature of the present invention is to provide a retractable enclosure comprised of displaceable structural bow frames which are constructed by a simple design thus reducing manufacturing labour costs and installation costs while increasing the modularity thus easing part replacement.

Another feature of the present invention is to provide a retractable enclosure comprised of displaceable structural bow frames and which may be supportably displaced on rails or directly on a ground or floor surface and thus reducing manufacturing labour costs and installation labour costs previously associated with the production of rails. The improved rail design provides a way of alleviating thermal stresses on the rails thus keeping the rails straight and aligned.

Another feature of the present invention is to provide a retractable enclosure comprised of displaceable structural bow frames which are comprised of fewer parts thus reducing inventory levels.

Another feature of the present invention is to provide a retractable enclosure comprised of displaceable structural bow frames and wherein the bow frames can be constructed without using structural welds, and wherein the profile strength thereof is not diminished while permitting structures to be designed using less material. Thus, the frame structure alleviates the issues associated with structural fatigue.

Another feature of the present invention is to provide a retractable enclosure comprised of displaceable structural bow frames which are designed with feature to provide increased wind and snow load capabilities.

Another feature of the present invention is to provide a retractable enclosure comprised of displaceable structural bow frames which are constructed with single extruded straight metal tubes which are interconnected by only two joint connector design and wherein the extruded tubes provide for attachments to many of the associated parts of the structure and further wherein the structural bow frames can be reinforced by interconnecting the straight metal tubes together side-by-side, by extruded spacer connections formed by cutting tube pieces from the straight extruded tubes.

Another feature of the present invention is to provide a retractable enclosure comprised of displaceable structural bow frames part of which can be pre-assembled in plant whereby the retractable enclosure can be erected quickly on site.

Another feature of the present invention is to provide a retractable enclosure comprised of displaceable structural bow frames and wherein long enclosures can be fabricated by an assembly of modules formed with a plurality of said displaceable structural bow frames and with the modules having reinforced end frames interconnected together in tight engagement by connectors.

Another feature of the present invention is to provide a retractable enclosure comprised of displaceable structural bow frames supporting a flexible tarp and wherein the tarp structure can be tensioned by a tensioning end frame of the enclosure.

According to the above features, from a broad aspect, the present invention provides a retractable enclosure comprising at least two displaceable structural bow frames. Each structural bow frame defining a roof section and opposed upwardly extending side sections. The roof and side sections are formed from extruded profiled straight metal tubes having a common profile and defining interconnection means. The profile straight metal tubes are interconnected together end-to-end by joint connectors coupled to the extruded interconnection means in opposed end sections of the profile straight metal tubes. A tarp, formed of a flexible material sheet, is interconnected between structural frame members. The tarp has opposed connecting edges removably attached in tarp attachment channels of the profiled straight metal tubes. A leg support assembly is secured to a lower end section of the side sections in one or more channel formations of the extruded straight metal tubes. The leg support assembly has a load support wheel for displacement of the structural frame members on a support surface to displace the bow frames in directions towards or away from one another to close or retract at least part of the enclosure.

BRIEF DESCRIPTION OF THE DRAWINGS

A preferred embodiment of the present invention will now be described with reference to the accompanying drawings in which:

FIG. 1 is a perspective view of the retractable enclosure constructed in accordance with the present invention and with part of the tarp being removed to show some of the displaceable structural bow frames;

FIG. 2 is a perspective view similar to FIG. 1 but showing the displaceable structural bow frames and the covering tarp retracted to one end of the retractable enclosure;

FIG. 13C is a cross-section view similar to FIG. 13B showing the rail and support wheels inverted;

FIG. 16 is a fragmented perspective view showing the assembly of a long retractable enclosure using the structural bow frames of the present invention with lift bow assemblies secured to the bow frames as well as lift bow frames connected adjacent opposed ones of the upwardly extending side sections of the bow frames and further illustrating the construction of end bow frames;

FIG. 17A is a perspective view showing the construction of the lift bow frames as well as trusses secured by connectors at opposed top ends of the side sections and the central connector of the roof section of the bow frame;

DESCRIPTION OF PREFERRED EMBODIMENTS

Figure 3:
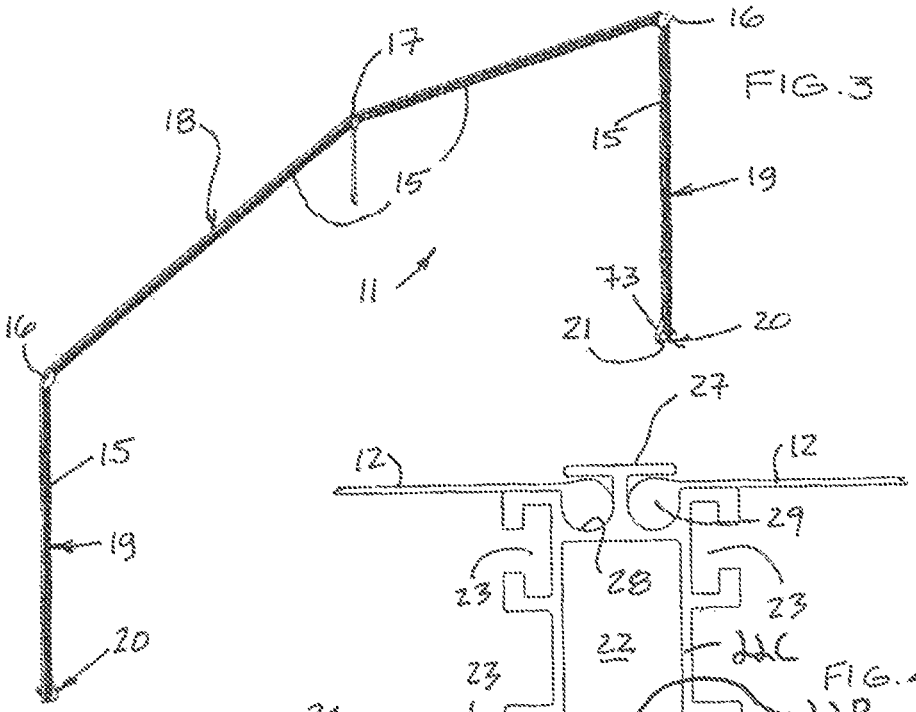
FIG. 3 is a perspective view showing the construction of a bow frames formed from common profiled straight metal tubes interconnected together by two joint corner connectors and a peak connector.

Referring now to the drawings and more particularly to FIGS. 1 and 2, there is shown generally at 10 a retractable enclosure which comprises at least two displaceable structural bow frames 11, herein a plurality of these being shown and which support tarp sections 12 between end walls 13 and 13' formed by end bow frames. As hereinshown end wall 13' has a door tarp section 14 for access to the enclosure 10 when in a rolled-up condition. Other forms of doors can be incorporated in the end walls 13 and 13'. Of course, the door 14 may have different configurations but as hereinshown it is a roll-up tarp section as shown at 14' in FIG. 2 when the door is in an opened position. FIG. 2 shows the retractable enclosure in a fully retracted condition where all of the structural bow frames 11 have been displaced towards one end of the enclosure. It is also pointed out that the enclosure can be constructed in modules which may contain one or more tarp sections 12 with the modules being interconnected together by end bow frames, as will be described later, and wherein the end bow frames can be secured to one another in a tight sealing manner.

Referring now to FIGS. 3 to 11B, there will be described the construction of the displaceable structural bow frames 11. As shown in FIG. 3, each of the structural bow frames 11 consists of an assembly of extruded profile straight metal tubes 15 which have a common profiled cross-section. These tubes are assembled together by corner connectors 16 and a peak connector 17 whereby to form a bow frame structure defining a roof section 18 and opposed, substantially vertical, side sections 19. The roof section 18 may be flat or pitched as illustrated herein. A leg support assembly 20 is secured to a lower-end section of the opposed side sections 19. The leg support assembly 20 has at least load support wheel 21 for displacement of the structural frame members on a support surface and in directions for displacing the structural bow frames 11 towards or away from one another to close or retract at least part of the enclosure 10, as illustrated in FIGS. 1 and 2.

Figure 4B:
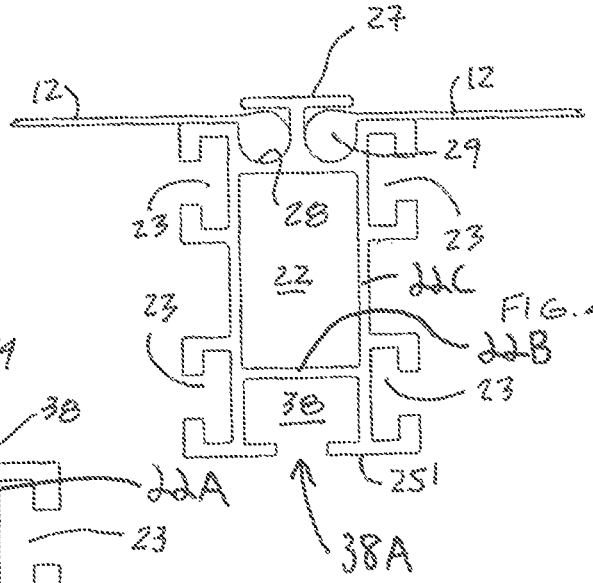
FIG. 4B is a view similar to FIG. 4A showing tarp sections attached to channel connectors of the metal tubes.
Figure 4A:
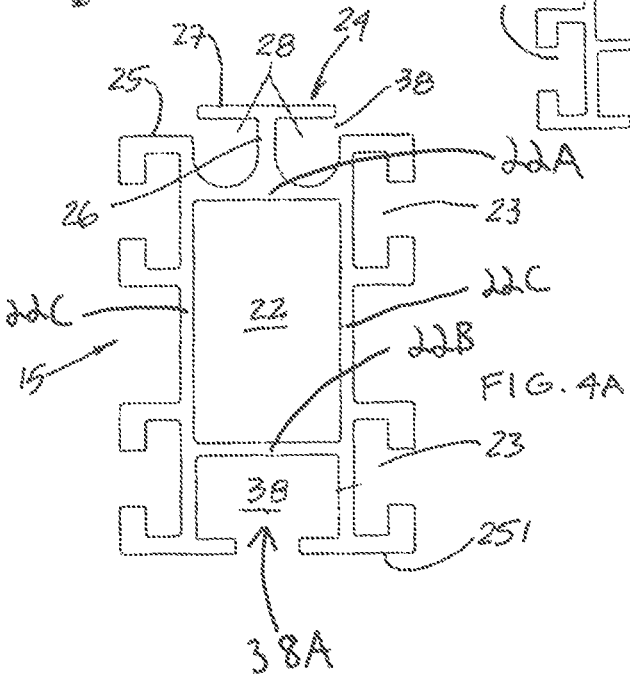
FIG. 4A is a transverse section view of the extruded straight metal tubes.

As shown in FIGS. 4A and 4B, the extruded profile straight metal tubes 15 have a common transverse profile defining interconnection means in the form of channels such as a central interconnecting channel 22 and side interconnecting channels 23. It also defines a T-shaped projection 24 extending above a top wall 25 thereof. The T-shaped projection defines a central wall 26 and a transverse top wall 27. Opposed, generally U-shaped tarp connecting channels 28 are formed under the transverse top wall 27 for receiving the enlarged connecting side edges 29 of a tarp section 12. Still referring to FIGS. 4A and 4B, a lower joint interconnecting channel 38 is defined adjacent to the central interconnecting channel 22. The central interconnecting channel 22 has an outer end wall 22A, an inner end wall 22B, and opposed side walls 22C. The inner end wall 22B has the lower joint interconnecting channel 38 formed therebehind. The lower joint interconnecting channel 38 has central slot opening 38A therealong.

Figure 5A:
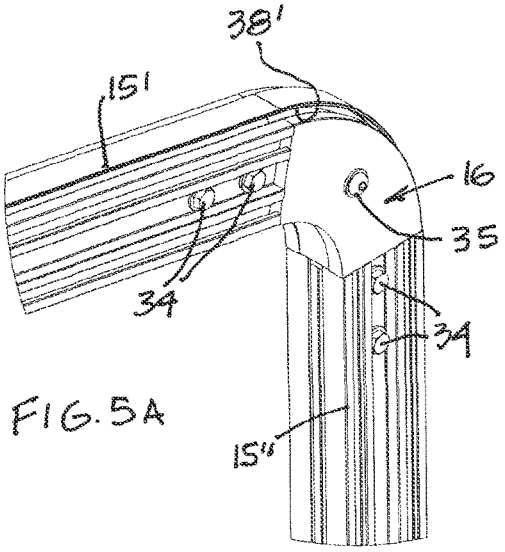
FIG. 5A is an enlarged perspective view showing the extruded profiled straight metal tubes interconnected by a joint connector.
Figure 7:
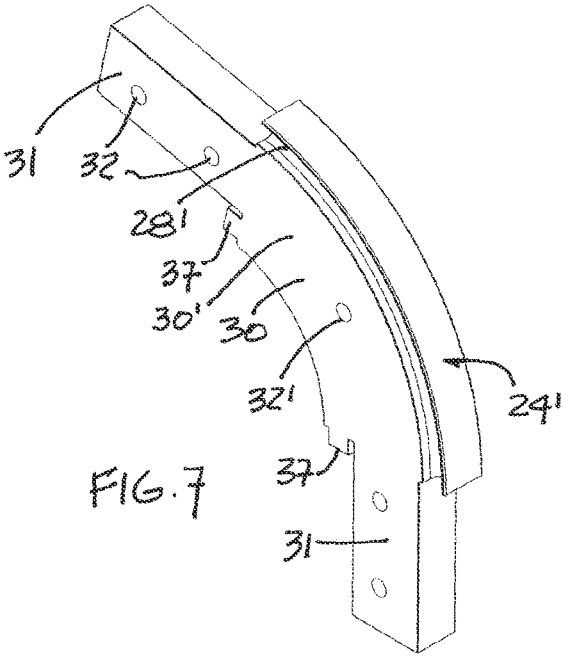
FIG. 7 is a perspective view showing the shape of a corner connector without the joint plate connected thereto.
Figure 8:
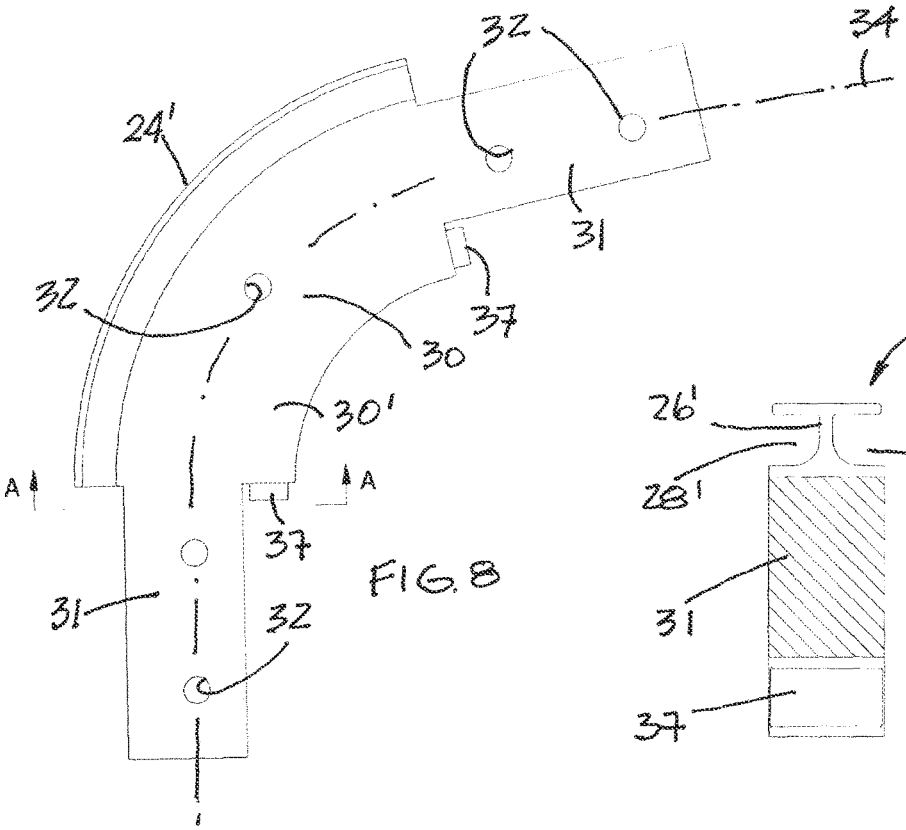
FIG. 8 is a side view of FIG. 7.
Figure 9:
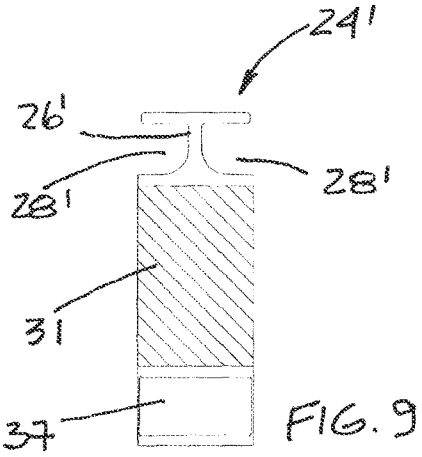
FIG. 9 is a cross-section view along cross-section AA of FIG. 8.
Figure 10A:
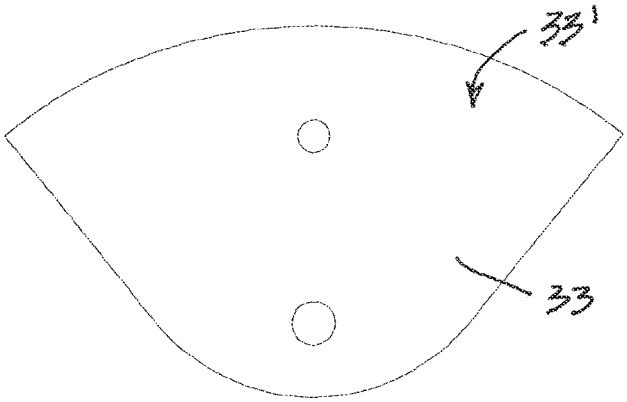
FIGS. 10A and 10B are side and edge views of a corner connector joint plate.
Figure 10B:
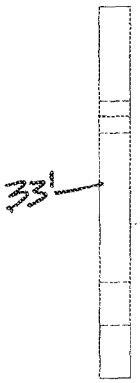
Figure 11A:
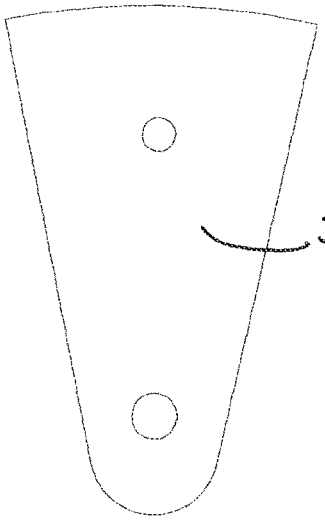
FIGS. 11A and 11B are side and edge views of a peak connector joint plate.
Figure 11B:
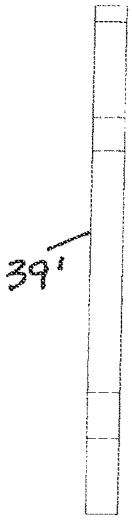

Referring now to FIGS. 5A and 7 to 10B, there will be described the construction of the corner connector 16 as better shown in FIGS. 7 to 9. The corner joint connector 16 is comprised of a rigid central body portion 30 having opposed connecting wing portions 31 integrally formed therewith. The central body portion and the wing connecting portions have transversal holes 32 therein for interconnection with profile straight metal tubes 15 and for connection with a corner connecting joint plate 33, as illustrated in FIGS. 10A and 10B. As can be seen from these drawings, the central body portion 30 and the opposed wing portions 31 extending from both ends of the central body portion and define an interconnecting axis, herein a curved axis 34, which determines the angle between the straight metal tubes 15 in the opposed side sections with respect to the straight metal tubes 15 in the roof section 18. These opposed connecting wing sections 31 are received in close sliding fit in the central interconnecting channel 22 of a straight metal tube 15. As shown in FIG. 5A, connecting bolt fasteners 34 secure the wing portions 31 to the end of the extruded metal tubes 15. The connecting fastener 35 secures the corner connecting joint plate 33 to each of the opposed side walls 30' of the rigid central body portion 30. The fastener 35 is engaged in the hole 32'. These holes 32 and 32' may be threaded to receive the connecting bolt fasteners 34 and 35.

Stub connecting projections 37 of rectangular cross-section extend from the central body portion 30 and are spaced under each of the opposed connecting wing portions 31 and are dimensioned for close-fit connection in a lower joint interconnecting channel 38 of the profile straight metal tube 15, as shown in FIG. 4A, whereby to provide added connection strength between the connectors and the straight metal tubes.

With reference now to FIG. 9, it can be seen that the corner connector 16 is also provided with a T-shaped projection 24' and it also has a central wall 26' to define on opposed sides thereof U shaped channels 28'. This T-shaped projection 24' is positioned to align itself with the T shaped projection 24 form on the top wall 25 of the straight metal tubes 15 once the corner connector 16 is secured thereto. In order to install the tarp sections 12 across two of the structural bow frames structures 11, the enlarged opposed beaded side edges 29 of the tarp section, see FIG. 4B, is inserted into one of the U-shaped channels 28 of the straight metal tube forming the roof section 18 via the larger U-shaped channel 28' above the rigid central body portion 30. The tarp enlarged beaded side edge 29 is secured to a wire or rope which pulls the enlarged beaded side edge 29 through the U-shaped channel 28 of the two cross bow frames selected. The selected bow frames may be alternate bow frames of bow frames of alternating fourth bow frames with the intermediate bow frames being mainly tarp supporting bow frames. After the tarp is pulled to the bottom of the opposed side section 19 it is secured to the bottom thereof and the remaining tarp section is then inserted into the U-shaped channel 28 of the vertical straight metal tubes 15" as illustrated in FIG. 5A via the U-shaped channel 28'.

After the tarp section is installed between two bow frames, the corner connecting joint plate 33 is secured in position to cause the tarp beaded edge to assume a smooth curve. As shown in FIGS. 4A and 5A, the U-shaped channels form a restricted throat opening 38 through which the tarp 12 extends and prevents foreign matter from lodging into the U-shaped channels 28. Likewise, the corner connecting joint plate 33 is dimensioned to form an aligned restricted throat opening 38', as shown in FIG. 5A.

Figure 5B:
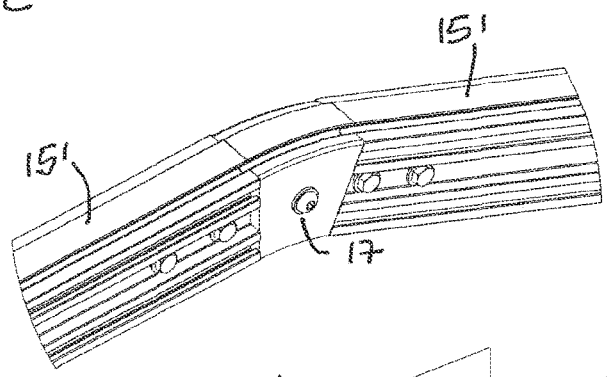
FIG. 5B is a perspective view showing two extruded profiled straight metal tubes interconnected by a peak connector to form the roof section of the structural bow frames.
Figure 4D:
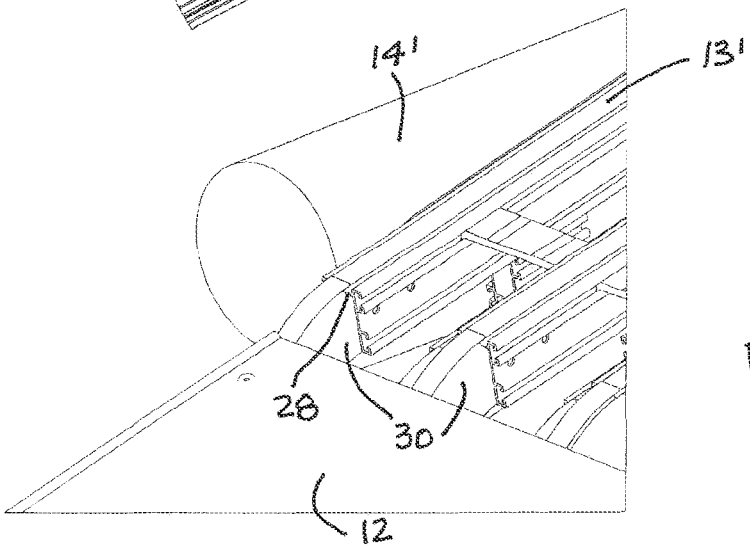
FIG. 4D is a fragmented perspective view of a corner of the bow frame enclosure illustrating where the securing edge of the tarp sections are introduced for connection to the straight metal tubes.

FIG. 5B shows the construction of the peak connector 17 and its construction is the same as described for the corner connector 16 except that the shape is different. It performs the same function as a corner connector and therefore it will not be described in detail herein as its construction is obvious to a person skilled in the art.

Figure 6A:
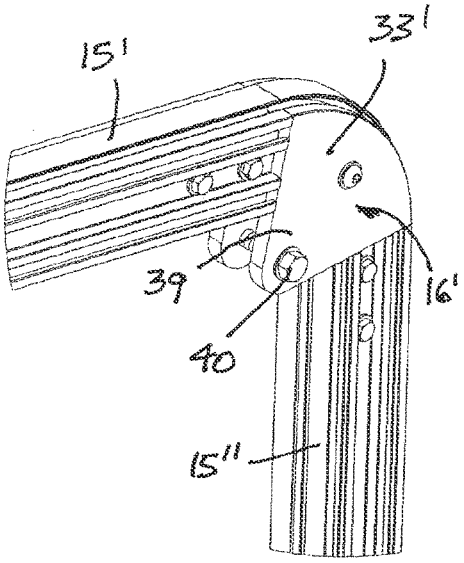
FIGS. 6A and 6B are perspective views showing alternative designs of the corner and peak joint connectors.
Figure 6B:
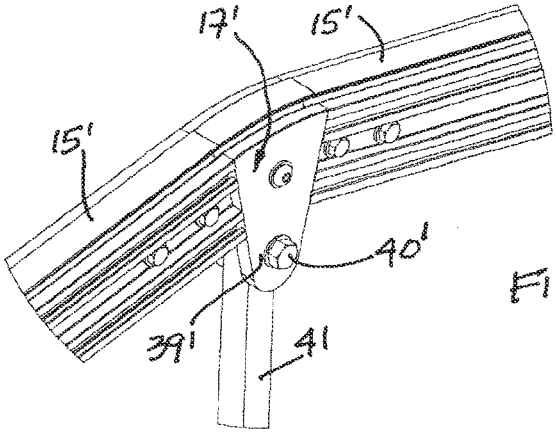

FIGS. 6A, 6B and 11A and 11B illustrate a variant of the corner connector, herein corner connector 16' and the peak connector, herein peak connector 17'. In this variant, the corner connecting joint plate 33' of the corner connector and the peak connector has an extended lower portion 39 and 39', respectively, which is adapted to receive an attachment bolt 40 and 40' whereby to secure thereto truss arms 41 or truss cables as will now be described, and shown in FIGS. 17A and 17B. A truss structure is attached under the pitch roof section 18 and between the opposed side sections 19 at a top end thereof. The truss structure is constituted by MF tubes or tension wire cables or straight flat metal bars 42 interconnected together between the corner joint plates and peak connecting joint plates as shown in FIGS. 6A and 6B and which also constitutes truss connectors. Truss connectors 43 are also mounted in the joint interconnecting channel 38 of the profiled straight metal tubes 15 constituting the pitch roof section 18. As herein shown, the straight metal rod 42 extends from across opposed ones of the corner joint connectors 16' and the truss arms 41 interconnect vertically thereto. A tie cable 44 provide load transfer connections between the lower end of the truss arms 41 and the peak joint connector 17' to transfer the loading of the roof sections to the opposed side sections 19.

Figure 12A:
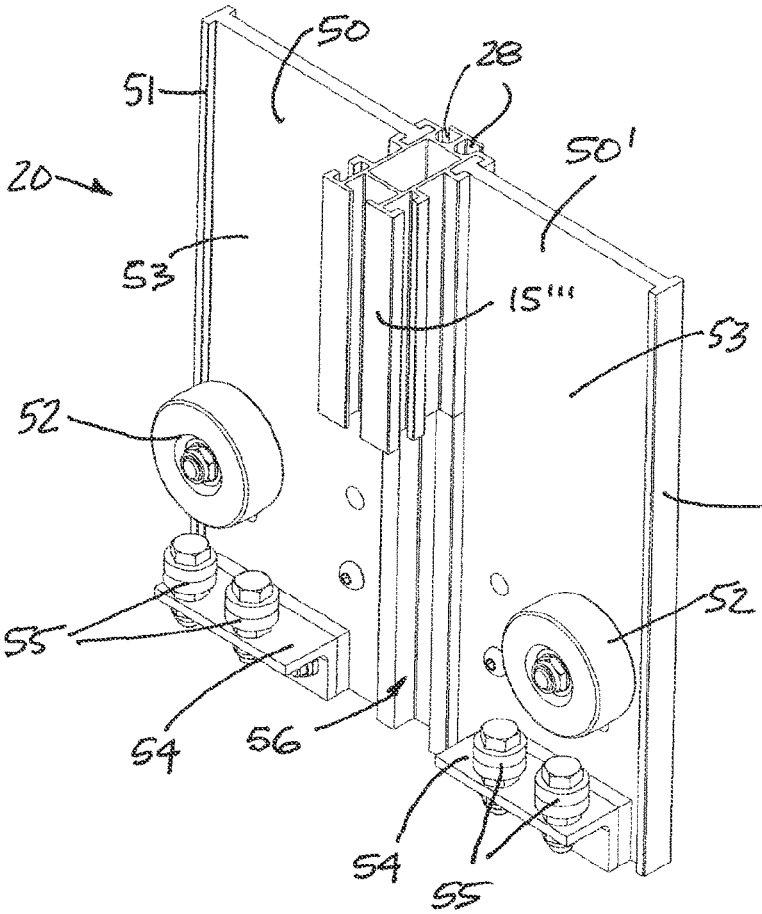
FIG. 12A is a perspective view of a leg support assembly showing a lower section of the extruded profiled straight metal tube, forming the side sections of the bow frames, connected thereto.
Figure 12B:
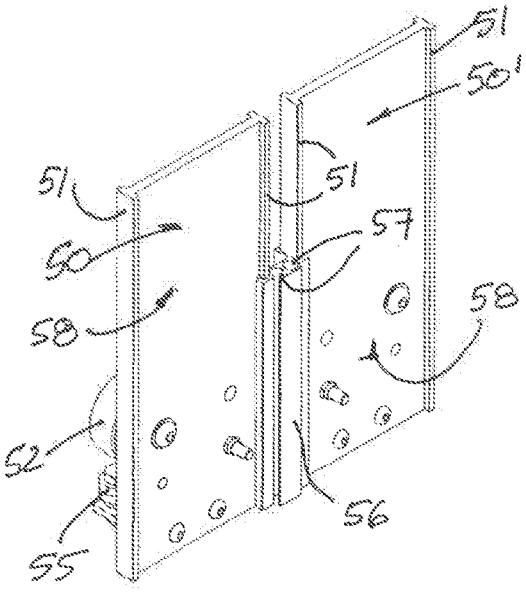
FIG. 12B is a rear perspective view of the leg support assembly.
Figure 12C:
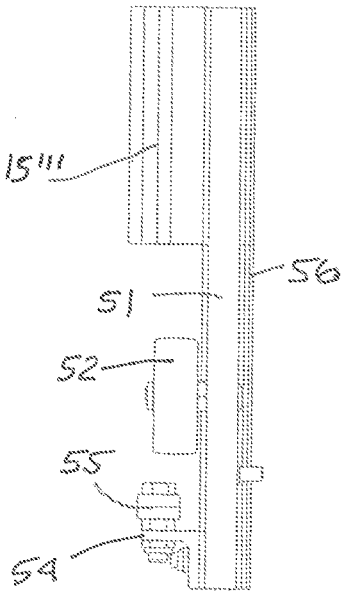
FIG. 12C is a side view of FIG. 12A.

Referring now to FIGS. 12A to 12C, there will be described the construction of one embodiment of the leg support assembly 20. As hereinshown, the leg support assembly 20 is comprised by a pair of rectangular metal plates 50 and 50' which are identical to one another and which are formed from an extrusion and define opposed profiled connecting edges 51 which are of T-shaped cross-section. To each of these plates is connected at least one load bearing support wheel 52 which extends from a flat side wall 53 of each of the pair of rectangular metal plates 50 and 50'. An attachment flange 54 extends transversally of the flat side wall 53 of each of the plates and is spaced under the load bearing support wheel 52 at a predetermined distance. At least one guide wheel, herein two guide wheels 55, are supported vertically on the flange 54 and spaced away from the flat side wall 53. The load bearing support wheel 52 and guide wheels 55 provide a wheel assembly for connection to a support track or rail.

As shown more clearly in FIGS. 12A and 12B, each of the rectangular metal plates 50 and 50' are interconnected together by a lower interconnecting extruded channel member 56 which slidingly receives a lower portion of the profiled connecting side edge 51 of the opposed plates 50,50' in side end channels thereof. As illustrated in FIG. 12B, the interconnecting extruded channel member 56 has tarp attachment channels 57 extending therealong and formed like the U-shaped channels 28, as illustrated in FIG. 4A, and these are disposed on an inner side 58 of the plates 50 and 50' behind the load bearing support wheel 52. The channel member 56 also provides a clearance on an outer side thereof, see FIG. 12C, for the support wheel assembly. A lower end section 15''' of the extruded profile straight metal tubes 15 of the opposed side sections 19 interconnects to the metal plates 50 and 50' and sits on top of the interconnecting extruded channel member 56 and with its U-shaped channels 28 aligned with the U-shaped channels 57 of the interconnecting channel member 56.

Figure 13A:
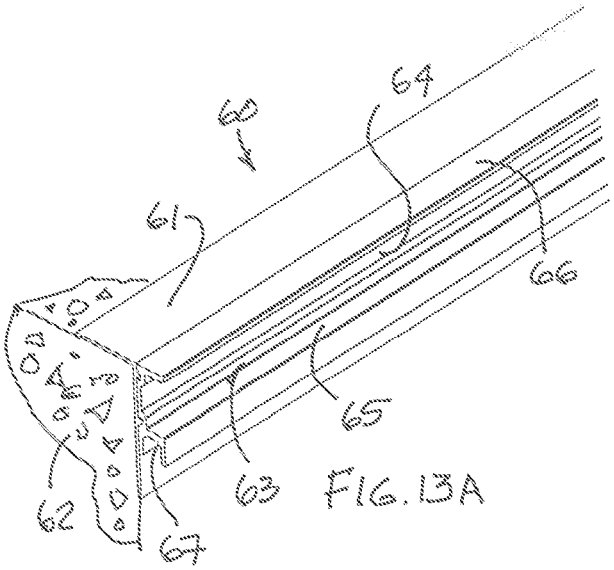
FIG. 13A is a perspective view showing the construction of the support rail on which the load bearing wheels of the leg support assembly are secured.
Figure 13B:
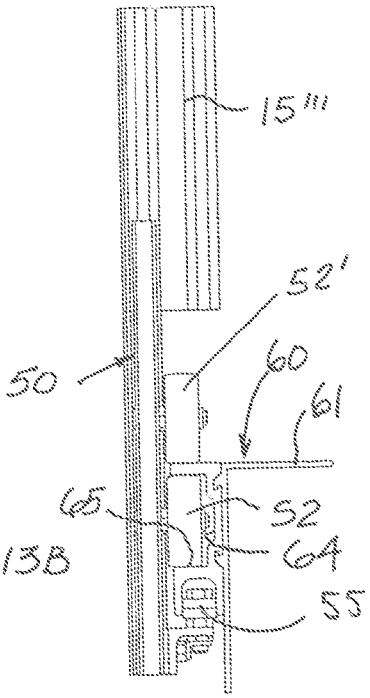
FIG. 13B is a cross-section view of the support rail of FIG. 13A and showing the leg support assembly coupled thereto.

Referring now to FIGS. 13A and 13B, there is shown the construction of a support rail on which the wheel assembly of the leg support assembly 20 is connected to. The support rail 60 has an attachment section 61 which is of L-shaped cross-section for immovable securement of the support rail on a ground attachment which may be a concrete wall 62 as illustrated in FIG. 13A. The support rail 60 also has a wheel engaging section 63 defining a support wheel cavity 64 having a wheel supporting horizontal wall 65 for support displacement of the load bearing support wheel 52 therein, as illustrated in FIG. 13B. Also, the leg plate may have an additional load bearing wheel 52' positioned to be supported on top of the attachment section 61. A depending cavity 67 is formed under the wheel supporting horizontal wall 65 for receiving the guide wheels 55 displaceably captive therein. A top horizontal wall 66 extends parallel above the wheel supporting horizontal wall 65 and is closely spaced to the top edge of the wheel of the load bearing support wheel when displaced therein. This top wall 66 also protects the cavity 64 from foreign matter. Also, double leg plates 50 can provide support of the bow frame on opposed sides of a support 62 where a rail 60 is secured to opposed top sides of the support. If the rail expands or retracts due to temperature fluctuation, the plates 50 will simply slide slightly on the rail and the rail will not buckle. Although FIG. 13B shows the rail 60 with the attachment section 61 upwards, the rail can also be inserted with the attachment section disposed flat on a support surface such as a slab and the wheels inverted on the plates 50, as shown in FIG. 13C.

Figure 14:
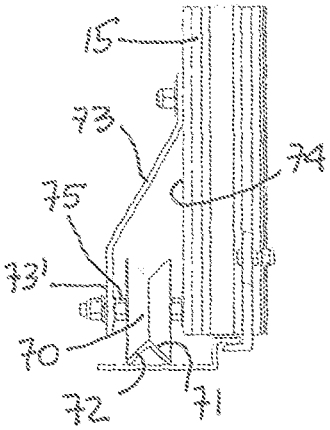
FIG. 14 is an end view of a further embodiment of the leg support assembly wherein the load bearing wheel is adapted to be supported on an inverted V-shaped track.

Referring to FIG. 14, there is shown another embodiment of the load bearing support wheel assembly. As hereinshown, it is comprised of a load bearing support wheel 70 having a concave V-shaped cross-section support surface 71 for seated rolling support on a convex V-shaped track 72. A wheel support bracket 73 is secured to a lower side portion 74 of the extruded profile straight metal tube 15 of the opposed side sections 19 of the structural bow frame. The wheel 70 is supported on an axle 75 supported at both ends between a lower portion of the straight metal tube 15 and the lower end 73' of the bracket 73.

Figure 18A:
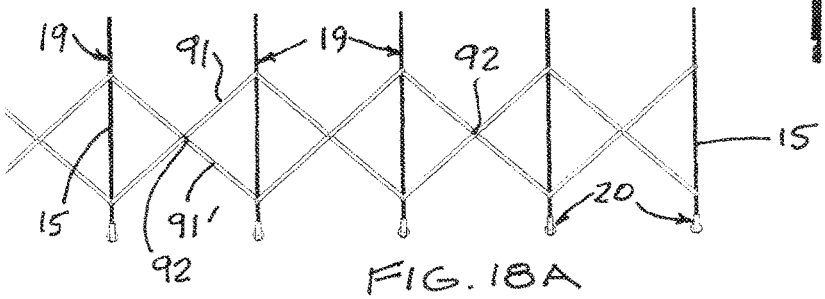
FIG. 18A is a part side view showing the opposed vertical extruded tubes of the bow frame illustrating the connection of the pantograph frames.
Figure 18B:
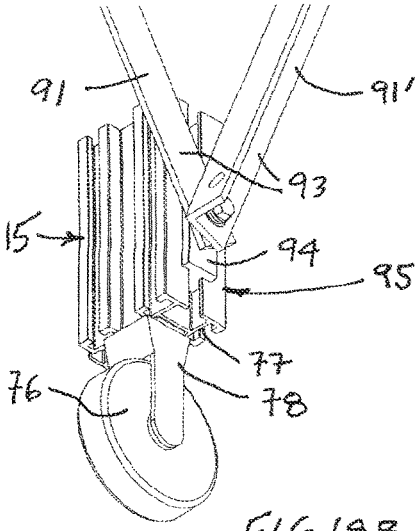
FIG. 18B is a perspective view showing the lower pivotal connection of the pantograph frame members to a side section profiled straight metal tube and wherein the leg support assembly constituted by a wheel secured at the lower end of the tube.
Figure 18C:
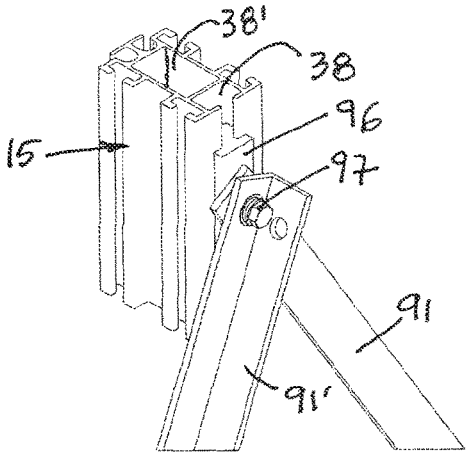
FIG. 18C is a perspective view showing the upper pivotal connection of the pantograph frame.

As also shown in FIG. 18B, the leg support assembly may comprise solely of a load bearing support wheel 76 secured under a lower end 77 of the extruded profile straight metal tube 15 of the opposed side sections 19 of the inverted bow shape frame. As herein shown, the wheel 76 is secured to a fork 78 having a top connecting post, not shown, but secured in the central interconnection channel 22 of the extruded straight metal tube 15.

With reference now to FIGS. 15A to 15D, there will be described the construction of a reinforce structural bow frame. As hereinshown the reinforced bow frame is comprised of two profiled straight metal tubes 15 interconnected together side-by-side in spaced relationship by spacer connectors 80. These spacer connectors 80 are simply short sections of the straight metal tube 15. These straight sections can be slid between opposed tubes and spot welded in place by weld joints not shown. The spacer connectors are interconnected as illustrated by the transverse views of FIGS.

15B to 15D. These double metal tube structures are interconnected at their corners and peak by corner connectors as previously described. The spacer connectors 80 are interconnected to the opposed tubes 15 by their T-shaped projection 24 projecting above the top wall 25 and their joint interconnecting channel 38 at the other end of the spacer connector 80. The thickness of the inner wall 25' (see FIG. 4A) provides a close fit under the transverse tarp wall 27 of the T-shaped projection.

Figure 15C:
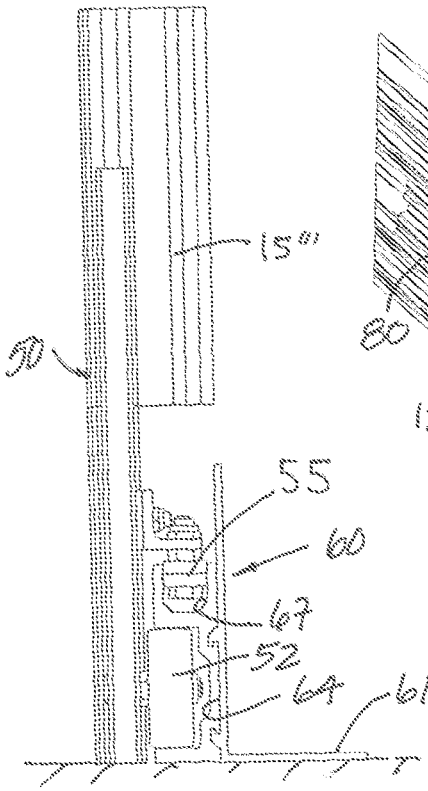
FIG. 15A is a fragmented view showing the construction of a reinforced bow frame utilizing a pair of bow frames interconnected together by spacer.
FIGS. 15B, C and D are cross-section views showing different designs of the bow frames fabricated from two or more bow frames interconnected together by spacers.
Figure 15A:
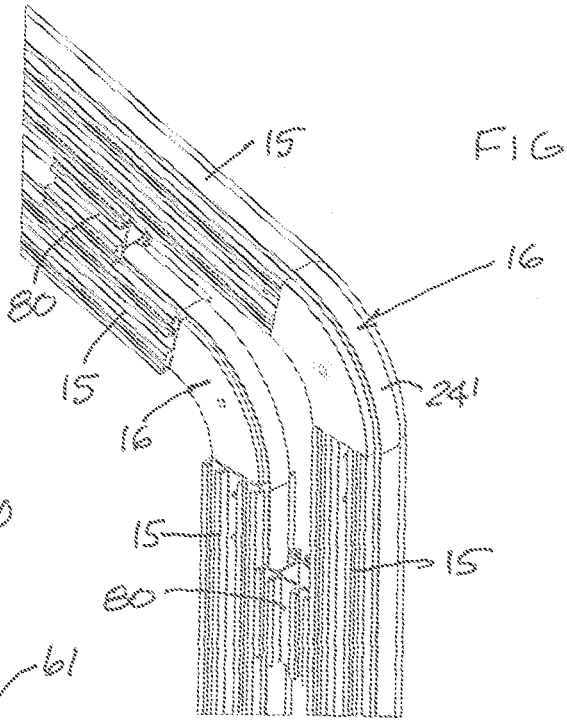
Figure 15B:
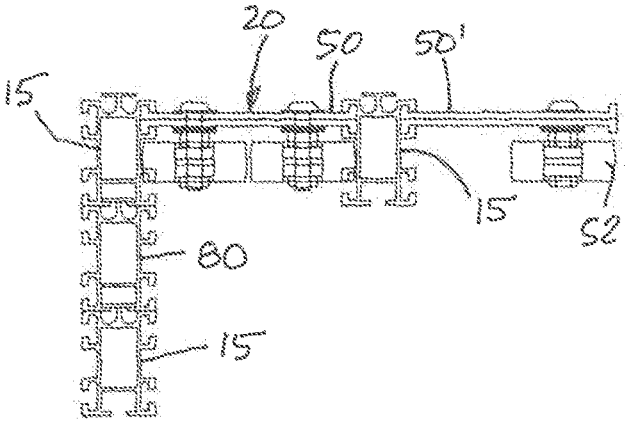

FIG. 15B is a top cross-section view illustration of the reinforced structural bow frame of FIG. 15A and secured to a leg support assembly 20 as previously described. FIG. 15C illustrates a further reinforced structural bow frame wherein two of the reinforced frames as shown in FIG. 15A are secured in spaced parallel relationship by the metal plate 50 of the leg support assembly as shown in FIG. 12A. A further metal plate 50 is connected at the opposite ends of the two interconnected straight metal tubes 15. FIG. 15D illustrates a still further reinforced structural bow frame wherein there are three of these double straight metal tubes interconnected together by metal plates 50.

With reference now to FIGS. 16, 17A to 17D, there will be described the construction of lift bow assemblies 82 which are secured to alternate ones of the structural bow frame structures and on opposite sides thereof. The lift bow assemblies 82 are each comprised by a bow-shaped tubular member 83 which is shaped to define a slope roof section 84 and opposed support side arm sections 85. The opposed side arm sections 85 are pivotally connected at a lower end thereof to a support bracket 86 which is connected to a side channel 15 of the side sections of the bow frame structure. The slope roof section 84 extends a predetermined distance above the roof section of the structural bow frame, as better seen in FIG. 17D, when said opposed side arm sections extend upright on their support bracket. However, in use the side arms extend substantially at the same level as the roof section 18 of the bow frame.

Figure 17C:
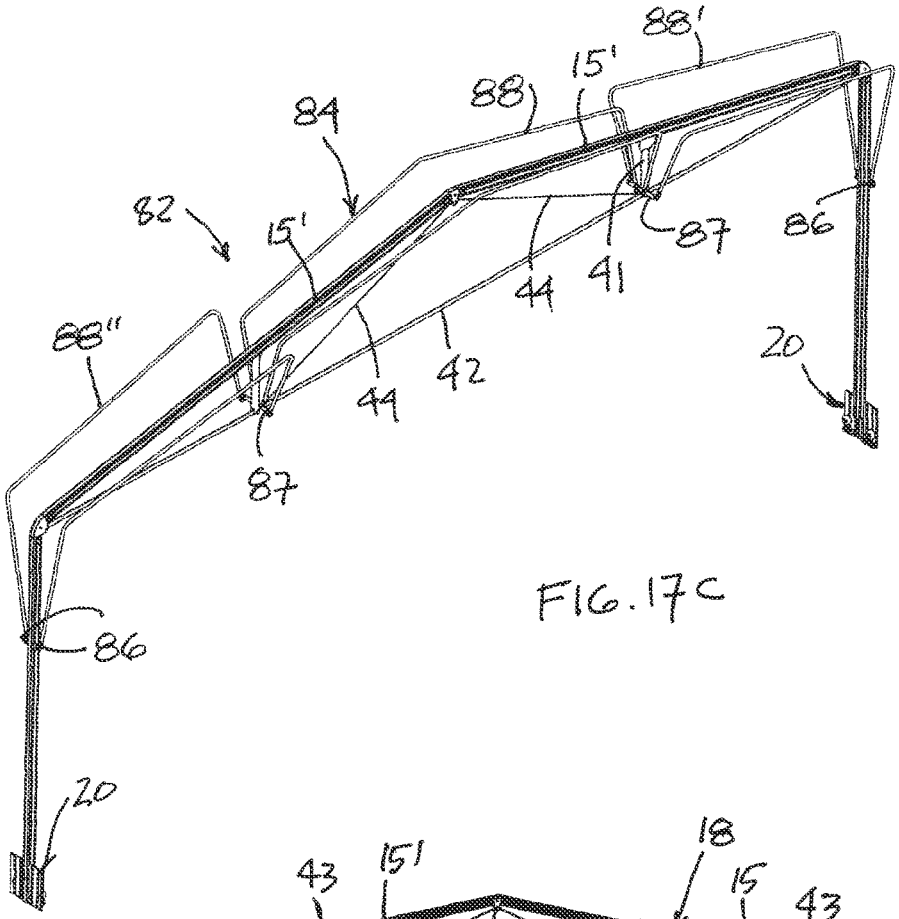
FIG. 17C is a perspective view showing a modification in the construction of the lift bow frame assembly.
Figure 17B:
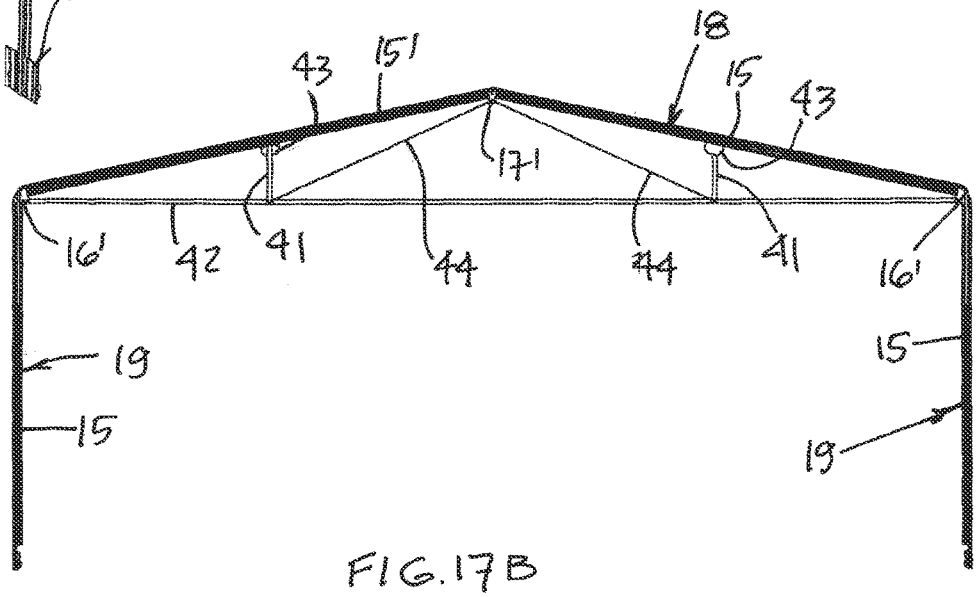
FIG. 17B is a side view illustrating the construction of the truss structure.
Figure 17D:
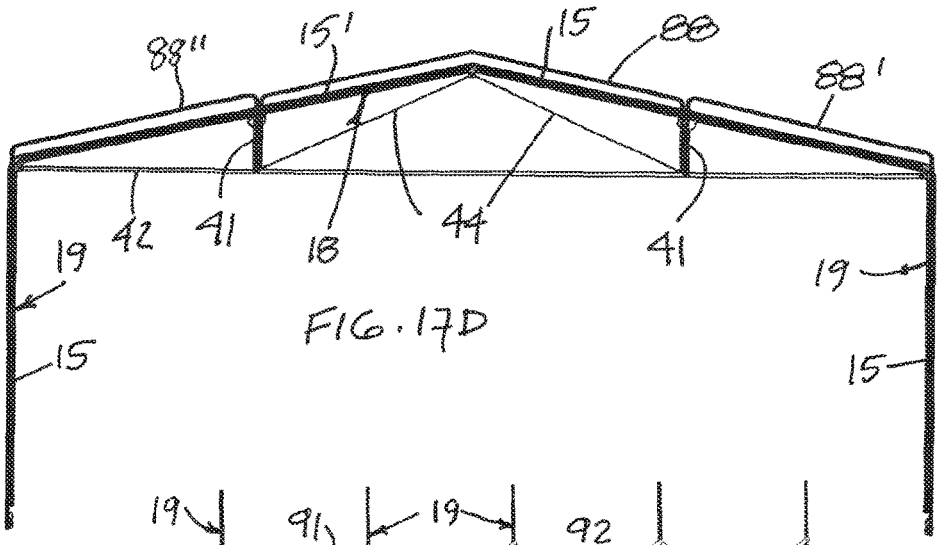
FIG. 17D is a side view of FIG. 17C.

As shown in FIG. 17C, the slope roof section 84 of the lift bow assembly 82 is formed in three sections 88, 88' and 88". The three sections are pivotally interconnected to support brackets 86 and intermediate brackets 87. The intermediate brackets 87 are secured to the truss rod 42 which is attached to the reinforced tubes 15' by vertical support rods 41.

Referring now to FIGS. 18A to 18D there will be described the construction of the pantograph frame 90 which interconnects adjacent ones of the displaceable structural bow frame structures. The pantograph frame comprises a pair of bars or rods 91 and 91' which are pivotally connected to one another at a central crossing point by a pivot connection 92. A lower end 93 of each of the pair of rods is pivotally secured to a stationary support bracket 94 secured in a connection channel 95 of an extruded connector member 95 which is profiled to interconnect with the lower end of a straight metal tube 15 of the opposed side sections 19 of the bow frame through a central interconnecting channel 38'. The support bracket 94 is fastened to extruded connector member 95. The extruded connector 95 can also be secured between the metal plates 50 and 50' of the leg support assembly 20 as illustrated in FIG. 12A. The upper end of the rods 91 and 92 are pivotally secured to a sliding support bracket 96 slidingly retained captive in the joint interconnecting channel 38 of the straight metal tube 15 of opposed one of the side sections of the bow frame. It is pointed out that the upper ends of the rods 91 and 91' may be fixed and the lower end displaced on a slide connector. It is pointed out that additional pantograph frames 90 can be secured between the bow frame structures if the enclosure is made higher. The pantograph frames also give additional strength to the side sections of the bow frames.

Figure 19B:
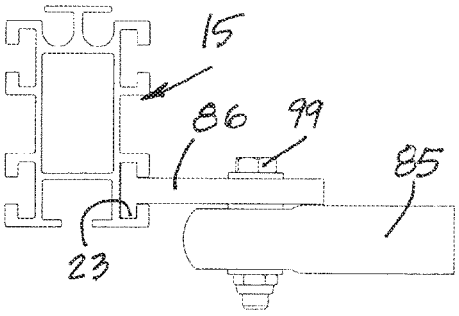
FIGS. 19A and 19B are fragmented perspective and top views, respectively, illustrating an alternative connection of the lift bow frame.
Figure 19A:
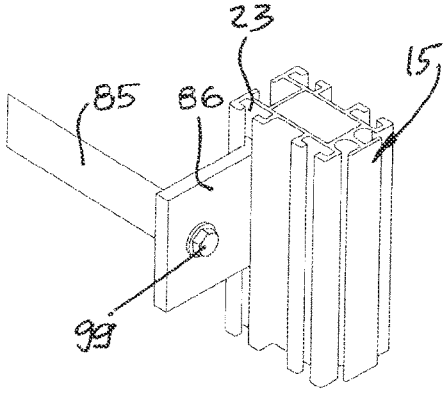

FIGS. 19A and 19B illustrate the connection of the side arm section 85 of the lift bow assemblies to the straight metal tubes 15. As shown, the bow attachment bracket 86 is immovably secured in a side interconnecting channel 23 of the straight metal tube 15 on a pivot connection 99.

As previously described with reference to FIG. 1 the retractable enclosure of the present invention may be constructed in shell units consisting of a plurality of bow frames, particularly when the retractable enclosure is very long whereby to facilitate the opening and closing of the structure from end-to-end or to the sides thereof. Shell units are identified by reference numeral 105 illustrated in FIG. 1 and they are formed by a plurality of the displaceable structural bow frames 11.

Figure 20:
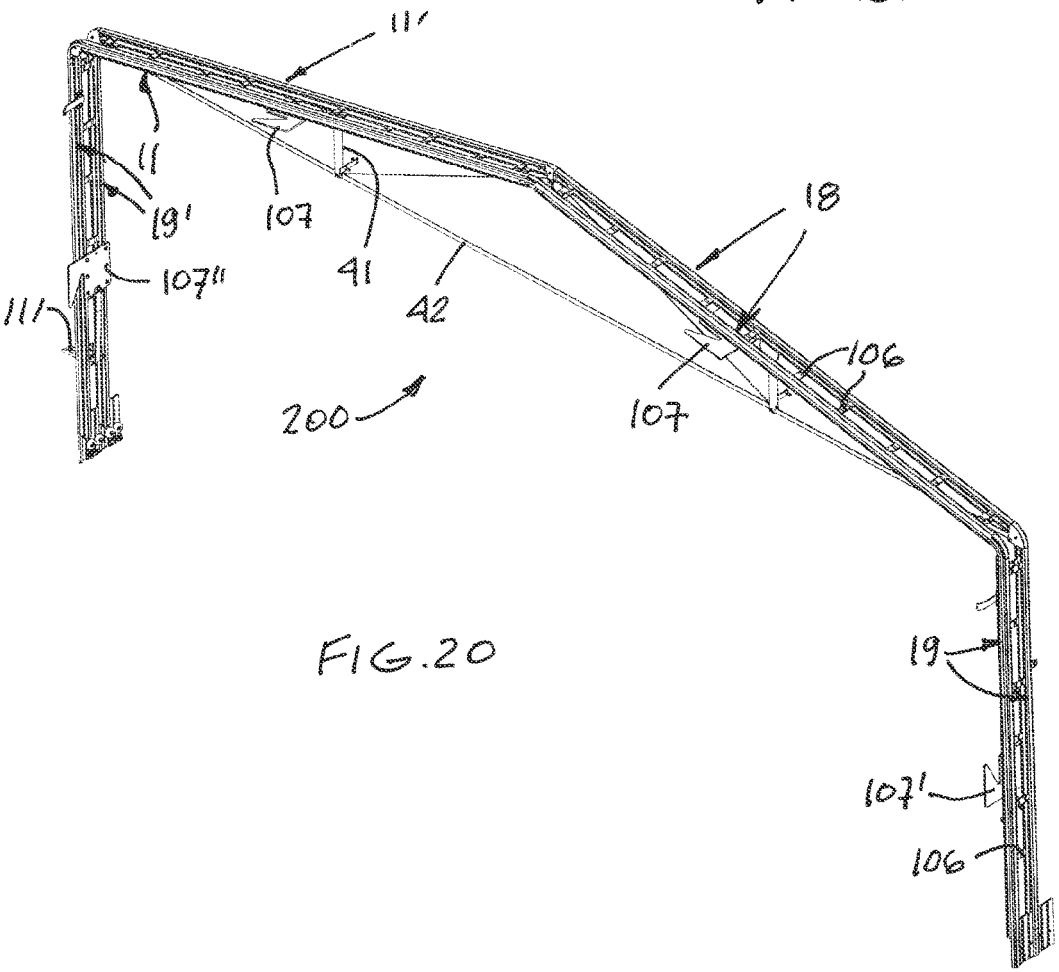
FIG. 20 is a perspective view illustrating an interconnecting end bow frame structure of shell units and the slide connectors which interconnect adjacent ones of these end bow frames together.
Figure 21A:
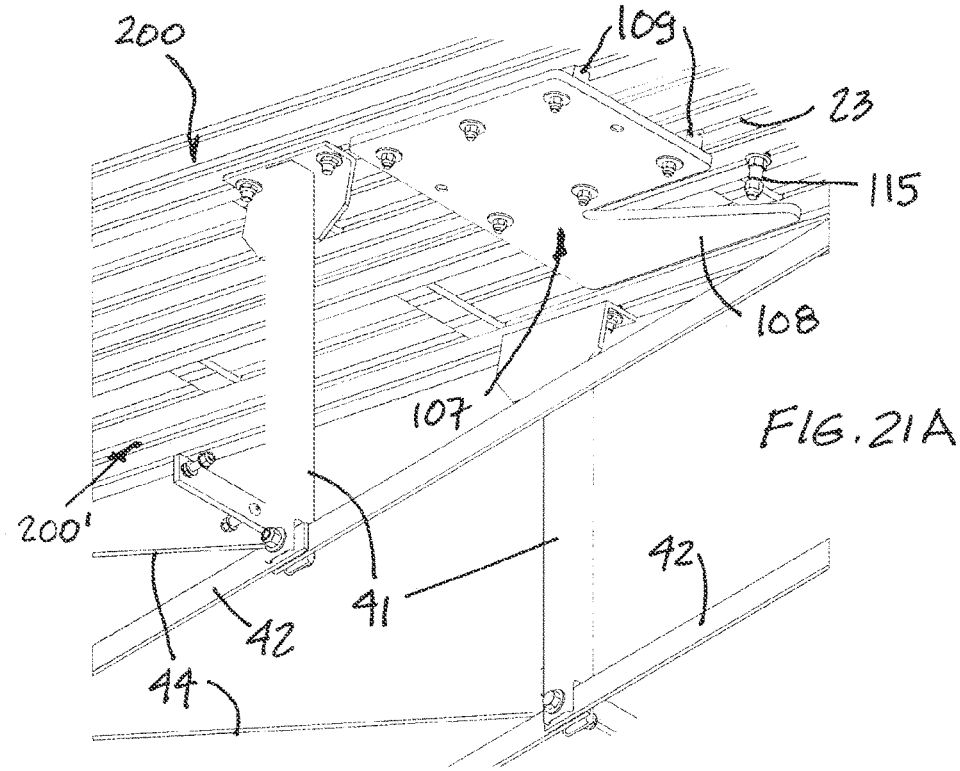
FIG. 21A is a fragmented perspective view showing the sliding plate connector secured to channels of a pair of profiled straight metal tubes interconnected together to form the roof section of an end bow frame and its relation to an engagement pin secured to an adjacent end bow frame.
Figure 21B:
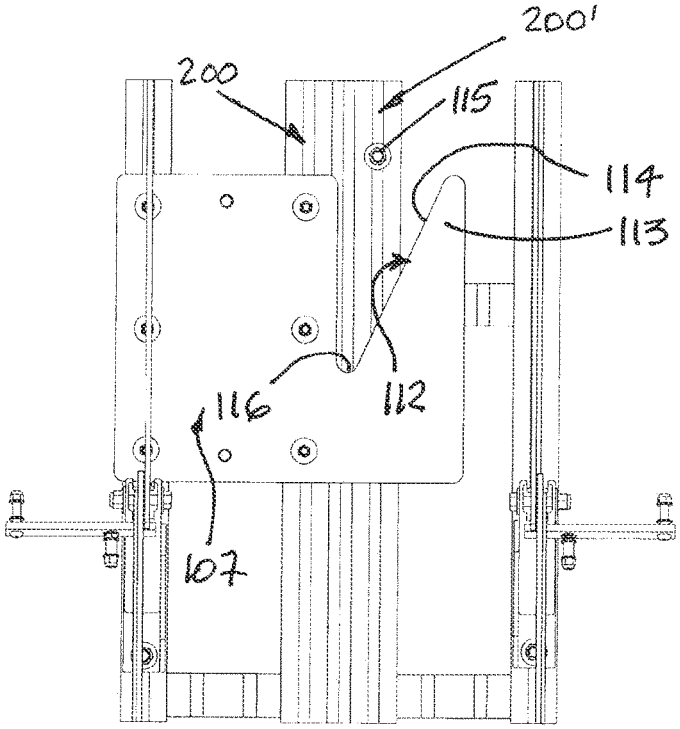
FIG. 21B is a fragmented plan view of the slide plate showing its relationship to the attachment pin of the opposed end frame.

The shell units 105 each have interconnectable end frames 200, one of which is illustrated in FIG. 20. Each of the opposed end frame 200 and 200' of adjacent shell units 105 are interconnected together by slide connectors 107 as will be described later. As can be seen from FIG. 20 each end frame is constructed of two bow frames 11 and 11' interconnected in spaced-apart relationship by spacer elements 106 at spaced intervals between the two bow frames. The spacer elements 106 which are welded across the bow frames 11 and 11'.

Figure 4C:
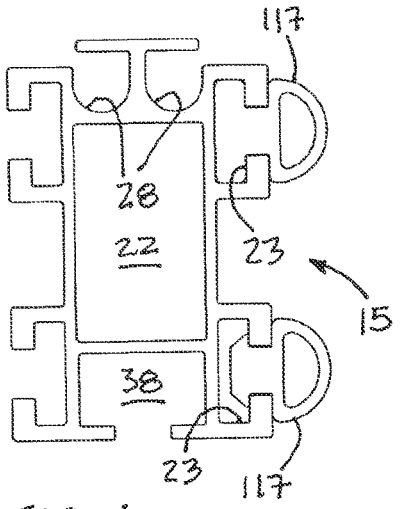
FIG. 4C is a view similar to FIG. 4A showing gaskets attached to channel connectors of the metal tubes.

Referring now to FIGS. 20 to 23, it can be seen that the slide connectors 107 are in the form of flat plates which are provided with attachment legs 109 on the rear face thereof, and which are displaceably secured in the side interconnecting channels 23 of the straight metal tubes of the bow frames 11 and 11'. A guide tether 110, see FIGS. 22 and 23, in the form of a wire or cable interconnects all these slide plates together whereby the slide plates can all be displaced in unison. The displacement of these plates is actuated by an actuating means in the form of a ratchet 111 of a type well-known in the art. Of course other types of tensioners can be used and operated mechanically or electrically. This ratchet has a locking mechanism as is well-known in the art. Each of the slide connectors 107 are identically formed and define a retracting notch 112 formed therein. The retracting notch 112 define a slope inner edge 114 behind an outer plate projecting finger formation 113 to capture an engageable element, herein a pin 115, see FIG. 21 which is secured to the opposed one 200' of the two bow frames 200 and 200'. The engagement pin 15 slides on the slope inner edge 114 as the slide plate 107 is displaced to draw the pin towards the base 116 of the retracting notch 112, thus drawing in the adjacent bow frame 200' in tight fit with the bow frame 200. In order to provide a better seal between these two interconnected bow frames gaskets 117, as shown in FIG. 4C, may be secured in the side interconnecting channels 23 of the straight metal tubes 15 at opposed ends of the two end frames being brought into interlocking relationship.

Figure 22:
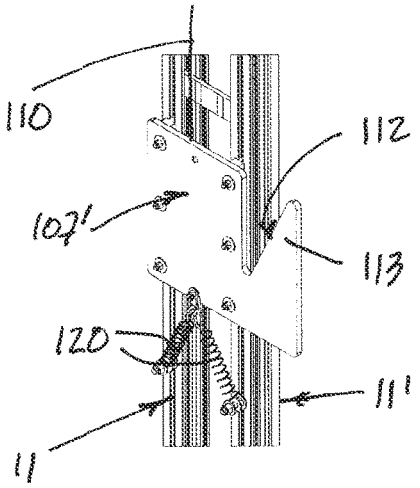
FIG. 22 is a perspective view of a sliding plate connector secured to one of an end frame side section and having a retracting springs connected thereto.
Figure 23:
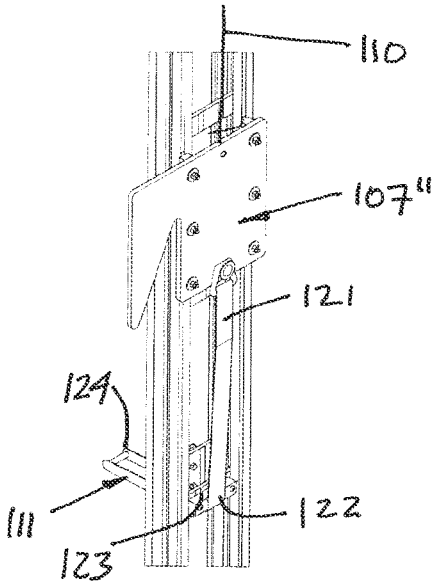
FIG. 23 is a perspective view similar to FIG. 22 but illustrating the sliding plate connector in the opposed side section of the bow frame and wherein a belt is releasably secured to a ratchet connected to the slide connector to displace all of the sliding plates of one end frame in unison.

As shown in FIGS. 22 and 23, it can be seen that the sliding plate 107', see FIG. 20, secured to one of the opposed side sections 19 of the end frame 200 is secured to retracting spring means in the form of a pair of springs 120 whereby to maintain all the sliding plates 107 in a disengaged position. The spring force of the springs 120 is selected to pull all of the sliding locking plates in that position via their interconnection by the tether wire 110. The sliding plate 107" secured to the opposed one of the opposed side sections 19, herein side sections 19', see FIG. 23, is connected to a ratchet 111 through a belt 121. This belt is secured at a lower end 122 thereof about a coil 123 of the ratchet. The coil is operated by the crank arm 124 to activate the ratchet, and coil the lower end of the strap 121 thereabout, thereby drawing the sliding plate 107" into a locked position. To unlock the plates, the ratchet 111 is provided with a release mechanism which disengages the ratchet, and causes the belt 121 to unwind from the coil by the pulling force of the springs 120. This type of ratchet is well-known in the art as above mentioned. Also, the tether wire 110 is guided by pulleys secured to the corner connectors and peak connectors.

Figure 24:
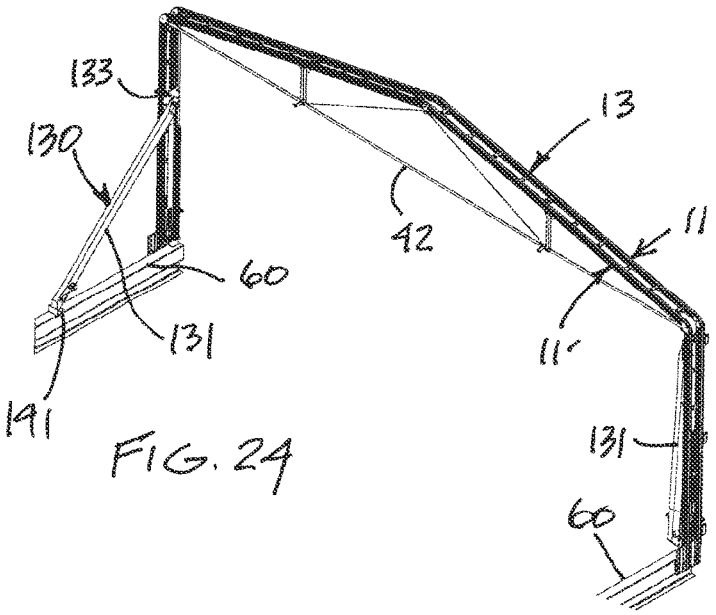
FIG. 24 is a perspective view showing the construction of an end frame provided with brace arm.
Figure 25:
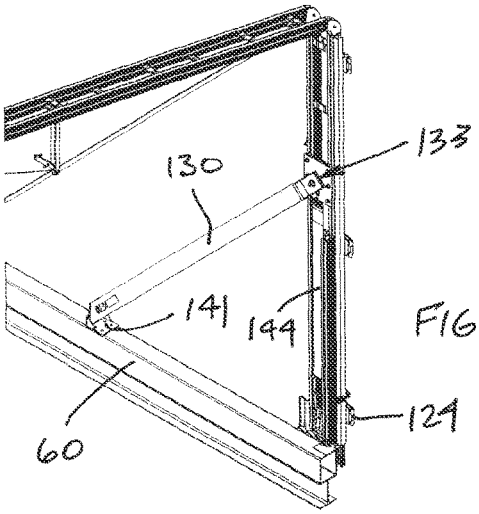
FIG. 25 is a fragmented perspective view showing the brace arm engaged.
Figure 28:
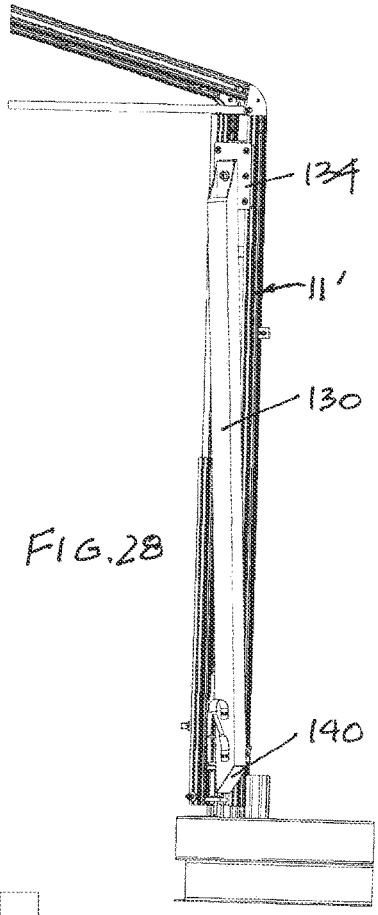
FIG. 28 is a fragmented side view of a side section of the bow frame with the brace arm supported at a storage position.
Figure 26:
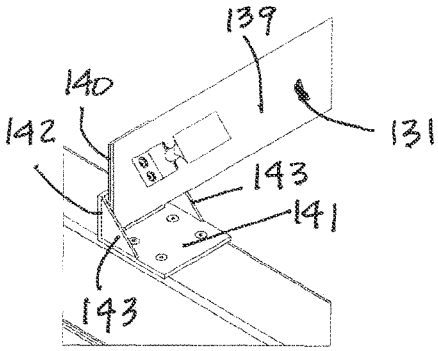
FIG. 26 is a fragmented perspective view showing the lower end connection of the brace arm.
Figure 27:
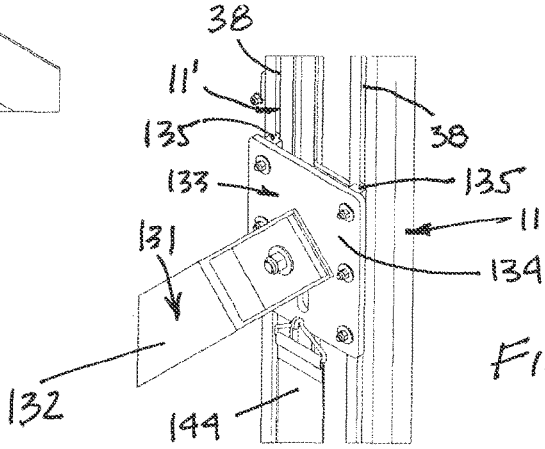
FIG. 27 is a perspective view showing the upper end connection of the brace arm secured to a slide plate.

With reference now to FIGS. 24 to 29, there will be described the construction of the end bow frames 13 and 13' by the retractable enclosure as illustrated in FIG. 1. The end frames 13 and 13' are constructed like the interconnecting end frames 200 described with reference to FIG. 20 but do not have sliding connectors. Therefore, the construction of the end bow frames 13 and 13' will not be repeated. As hereinshown, one or both end bow frames 13 and 13' is provided with a brace arm assembly 130. The brace arm assembly comprises a brace arm 131 pivotally connected at a top end 132 to a vertical slide connector 133 which is a flat slide plate 134 having attachment legs 135, see FIG. 27, which are slidingly secured in interconnection channel 38 of adjacent bow frames 11 and 11'. The other end 139 of the brace arm 131 has an abutting formation 140 for abutting retention against an abutment bracket 141 and specifically against a vertical abutment wall 142 of the attachment bracket. It is restrained between opposed side walls 143 of that bracket whereby to wedge the lower end 139 of the brace arm 131 against the abutment wall 142. The slide plate 134 is connected at a lower end thereof to a strap 144 which is connected at a lower end, between the opposed bow frames 11 and 11', to a ratchet of the type as described in FIG. 23. The actuating lever 124' of this ratchet is illustrated herein and the ratchet construction is obvious to a person skilled in the art and has been briefly described hereinabove with reference to FIG. 23. By positioning the brace arm 131 in the position as shown in FIG. 24 and actuating the ratchet, causes the slide plate 134 to be pulled down by the strap 144. This exerts a pushing force against the end bow frame 13 to push it towards the end of the enclosure and thereby exerting a pulling force on all of the bow frames of the structure thereby applying a tension to the tarp sections between the plurality of the displaceable structural bow frames intermediate opposed end frames 13 and 13'. When the end frames 13 or 13' required to be displaced, the ratchet is unlocked thereby releasing the strap 144 and causing the end frames to move slightly inwardly of the enclosure to permit the disengagement of the brace arms 131 and permitting the brace arm to be positioned at its stored vertical position, as shown in FIG. 28, where the slide plate 134 has been pulled to an upper position. Retention means 145 is provided to maintain the brace arm in this stored position.

Figure 30:
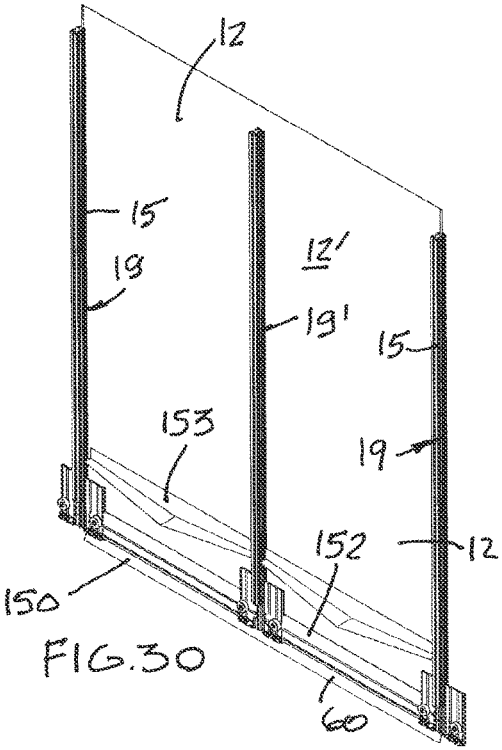
FIG. 30 is a perspective view showing the connection of a tarp section between alternate ones of the bow frames and wherein the tarp section is provided with a condensation wicking fin and a wear resistant fin skirt.
Figure 29:
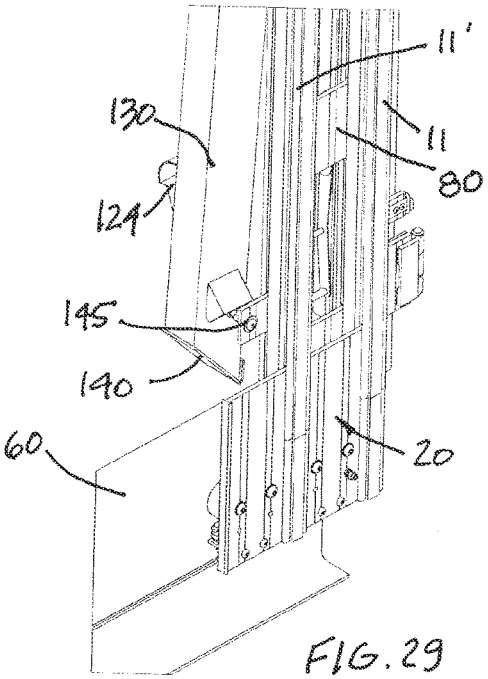
FIG. 29 is a fragmented perspective view of the lower end of the side section of the bow frame illustrating in part the wedge connection to the slide plate by a belt, similar to the winch as illustrated in FIG. 23.
Figure 31:
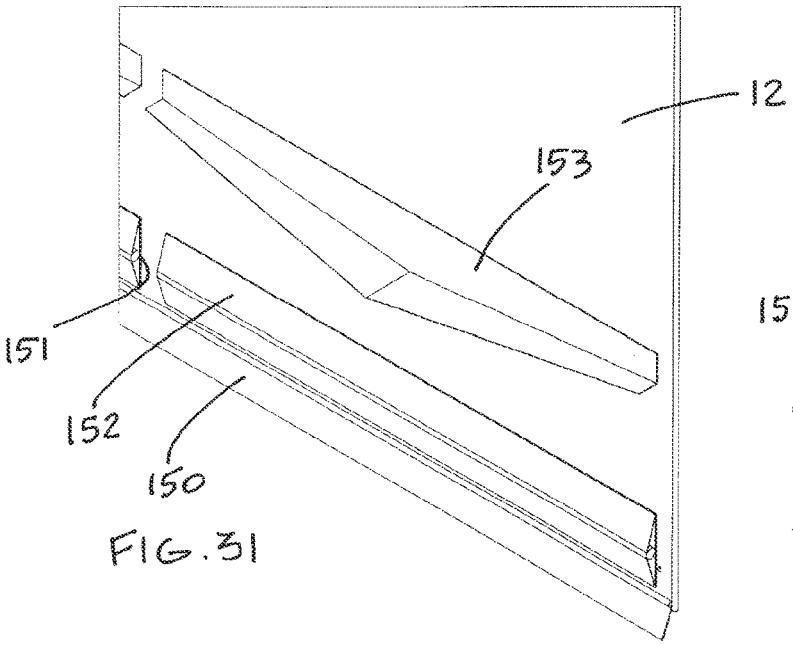
FIG. 31 is an enlarged fragmented perspective view of part of the lower end of the tarp of FIG. 30.
Figure 32:
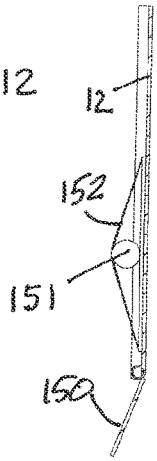
FIG. 32 is a cross section view of the bottom end of FIG. 31.

Referring to FIGS. 30 to 32, there is shown a tarp section 12 interconnected between the extruded metal tubes 15 of alternate opposed side sections 19 of structural bow frame structures. This tarp section 12 is formed of wear-resistant flexible material. The inner surface 12', inside the retractable enclosure 10, has a wear-resistant fin skirt 150 secured thereto, as better illustrated in FIGS. 31 and 32. The fin skirt 150 extends on a lower end portion of the tarp and is angled towards the support rail, such as the rail 60 shown in FIG. 30, to stop air flow in and out of the retractable enclosure. The fin skirt 150 extends between adjacent ones of the plurality of displaceable structural bow frames 11. As also illustrated in FIG. 31, a flexible rod or flat bar or strip 151 is secured to the inner surface 12' of the tarp in an envelope 152 and disposed above the fin skirt 150. The rod 151 has a memory bend whereby to push the lower end of the tarp section between each of the bow frames 11 outwardly from the enclosure as the bow frames are displaced closer to one another. As also seen in these Figures, the lower end of the tarp section 12 is further provided on the inner surface 12' thereof with a condensation wicking fin 153 constructed of material capable of absorbing condensation forming on the inner surface of the tarp and dripping down and to direct this condensation inwardly of the support rail 60 to prevent water from freezing on the support rail.

Figure 33:
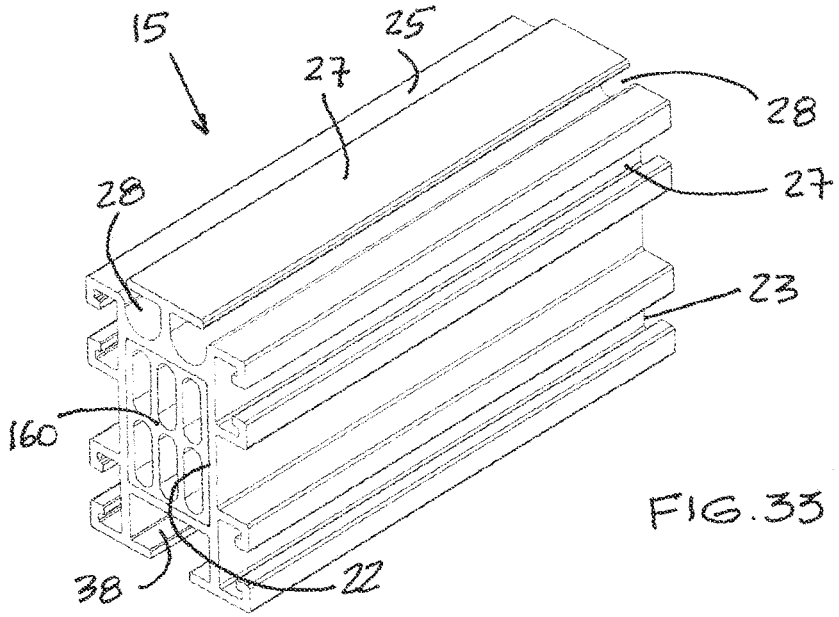
FIG. 33 is a perspective view illustrating a section of the extruded profiled straight metal tube having a reinforcing insert located in a central rectangular channel thereof.

With reference to FIG. 33, it can be seen that the extruded profile straight metal tubes 15 may be reinforced by inserting a reinforcing insert 160 in closed sliding fit in at least sections of the central interconnecting channel 22 of the straight metal tubes 15 to provide reinforcement. The insert can be constructed of rigid plastic material or other suitable material and as hereinshown, the insert is formed from an extrusion. These extruded profile straight metal tubes 15 are also extruded from structural aluminum and are of suitable gauge.

Figure 34:
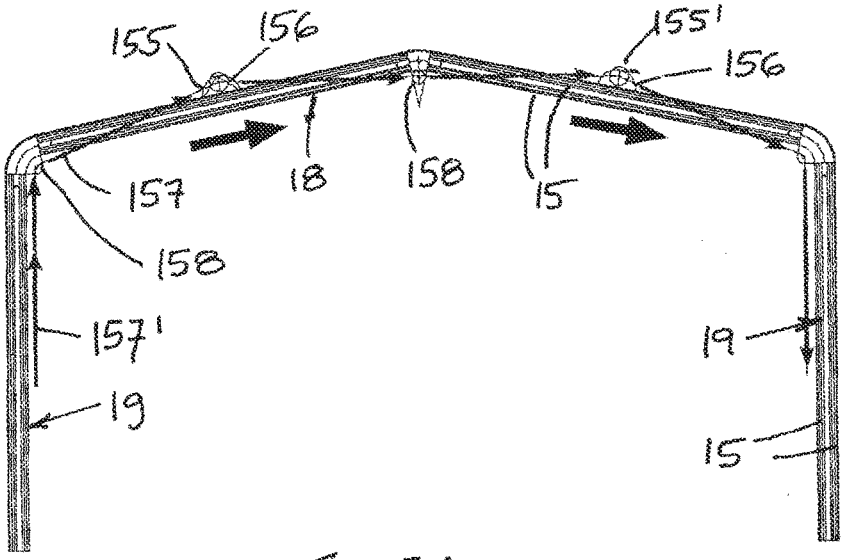
FIG. 34 is a side view illustrating a snow/ice removal assembly secured to carriages displaceably secured to connecting channels of the roof sections of an intermediate bow frame whereby to dislodge and break ice or packed snow that may form on the roof section of the tarp spanning the intermediate bow frame.

With reference now to FIG. 34, there is shown two snow/ice removal devices 155 and 155' secured to carriages 156 displaceably secured to connecting channels, such as the U-shaped channels 28 of an intermediate bow frame structures, such as the bow frame 19' to which the tarp is not connected. Accordingly, an unattached tarp section extends over the intermediate bow frame structure. The snow/ice removal devices can be displaced back and forth by a guided tether wire or cable 157 which is trained about pulleys 158. Opposed depending end sections 157' of the cable is made accessible adjacent the opposed side sections of the structural bow frame structure to permit a person to pull the tether from opposed ends whereby to displace the carriages 156 back and forth along the intermediate bow frame structure whereby to dislodge ice or packed snow on the tarp section intermediate their end connections.

It is within the ambit of the present invention to cover any obvious modifications of the preferred embodiments described herein. For example, the tarp sections may be formed of one or more layers of flexible textile material and that material may have insulation properties. Various other attachment mechanisms or articles can be connected to the profiled channels of the straight metal tubes to hang storage structures or tools from the roof structural metal tubes or the trusses. A suitable electrical wiring can also be supported by brackets secured to the opposed side sections of the bow frames or the roof sections thereof by attachments and these attachments may also support fixtures. Flexible heating ducts may also be supported by brackets attached to these bow frame structures particularly when the retractable enclosure is used as a permanent closed enclosure.

We claim:

1. A retractable enclosure, comprising:

at least two displaceable structural bow frames, each bow frame having a roof section and opposed upwardly extending side sections, said roof and side sections being formed from extruded metal tubes, each extruded metal tube defining a top wall, an inner end wall and opposed side walls, said top wall having a T-shaped projection extending partly above said top wall, said inner end wall having a lower joint interconnecting channel formed therebehind, said lower joint interconnecting channel having a central slot opening, at least one of the roof section and the side section having two or more extruded metal tubes interconnected together in a side-by-side relationship, said metal tubes being interconnected along a length thereof between opposed end sections of said metal tubes, a tarp formed of a flexible material sheet interconnected between said two bow frames, said tarp having opposed connecting edges removably attached in tarp attachment channels formed in said T-shaped projection of said metal tubes, a leg support assembly secured to a lower end section of said metal tubes of said side sections in one or more channel formations, said leg support assembly having a load support wheel for displacement of said bow frames on a support surface and in directions towards or away from one another to close or retract at least part of said enclosure, and joint connectors interconnecting and spacing apart the opposed end sections of said metal tubes, each joint connector having a central body portion having opposed connecting wing portions integrally formed therewith, said central body portion and opposed connecting wing portions defining an interconnection axis between two of said metal tubes interconnected thereby, said wing sections being received in a central joint interconnecting channel of said metal tubes, and fasteners to secure said connecting wing sections in said central joint interconnecting channel, one of said joint connectors being a corner joint connector for interconnecting metal tubes forming said roof section to metal tubes forming said side sections, the central body portion of said corner joint connector defining a curvature wherein said opposed connecting wings interconnect said metal tubes of said roof section at an angle with respect to said metal tubes of said side sections.

2. A retractable enclosure as claimed in claim 1 wherein there is further provided a stub connecting projection extending from said central body portion and spaced under each said opposed connecting wing portions and dimensioned for close fit connection in said lower joint interconnecting channel of said metal tubes to provided added connection strength.

3. A retractable enclosure as claimed in claim 1 wherein the central body portion of each joint connector has a T-shaped projection extending outwardly from a top wall thereof, said T-shaped projection having a central wall intersecting a transverse wall, opposed generally U-shaped channels under said transverse wall forming mating alignment with opposed tarp attachment channels formed in said T-shaped projection of said metal tubes when said joint connector is secured to a pair of straight metal tubes, said U-shaped channels having an open end facing outwardly to opposed sides of said central wall.

4. A retractable enclosure as claimed in claim 3 wherein said U-shaped channels of said central body portion provide an open gap on opposed sides of said T-shaped projection for access to said opposed ones of said tarp attachment channels of said metal tubes of said roof section and of said side sections, and a corner plate securable to opposed side walls of the central body portion and having a top channel forming edge shaped to maintain said connecting edges of said flexible material sheet aligned with said tarp attachment channels of said straight metal tubes of said roof and opposed side sections.

5. A retractable enclosure as claimed in claim 4 wherein said roof section is a pitched roof section, said pitched roof section being formed by two of said metal tubes interconnected together at one end by a peak joint connector, said peak joint connector being formed with wing portions extending from a central body portion at identical pitch angles to form opposed sloped roof sections, and a truss structure attached across a top end of said metal tubes forming said opposed upwardly extending side sections.

6. A retractable enclosure as claimed in claim 5 wherein said truss structure includes a wire cable or a straight metal rod interconnected between said corner connectors, some of said truss connectors being depending vertical connectors secured in a lower side channel of said profiled straight metal rods of said pitched roof section and said wire cable or straight metal rod extending from across opposed ones of said corner joint connectors, said truss structure reinforcing said inverted bow frame.

7. A retractable enclosure as claimed in claim 1 wherein said T-shape projection is formed integral with said top wall of said metal tubes and extending centrally thereabove, said T-shaped projection defining a central wall and a transverse top wall spaced above said top wall of said metal tubes, opposed generally U-shaped tarp attachment channels formed in said top wall and projecting inwardly in said top wall and defining a restricted throat opening between outer end edges of said transverse top wall of said T-shape projection and said top wall of said metal tubes, said tarp having opposed connecting longitudinal edges defining a flexible bead-like enlarged edge.

8. A retractable enclosure as claimed in claim 1 wherein said leg support assembly is comprised by a pair of metal support plates each having opposed profiled connecting side edges, a lower interconnecting extruded channel member for slidingly receiving a lower portion of said profiled connecting side edges of adjacent plates in side end channels thereof, said interconnecting extruded channel member having tarp attachment channels on an inner side thereof and providing a clearance on an outer side thereof for a support wheel assembly of said leg support assembly, a lower end section of said metal tubes having opposed side connecting channels for receiving an upper portion of said profiled connecting side edges of said plates, a load bearing support wheel extending from a flat side wall of said pair of rectangular metal plates in a lower portion of said support plates, a flange extending transverse to said flat side wall and spaced under said load bearing support wheel, and at least one guide wheel supported vertically on said flange and spaced from said load bearing support wheel and said flat side wall.

9. A retractable enclosure as claimed in claim 8 wherein there is further provided a support rail along which said leg support assembly is displaced, said support rail having an attachment section for immovable securement of said support rail, and a wheel engaging section secured to said attachment section, said wheel engaging section defining a flat support flange for supporting displacement of said load bearing support wheel, and a depending cavity under said flat support flange wall for receiving said at least one guide wheel displaceably captive therein under said flat support flange wall and maintaining said load bearing support wheel captive for displacement on said rail.

10. A retractable enclosure as claimed in claim 1 wherein said leg support assembly is comprised of a load bearing support wheel assembly secured under a lower end of said metal tubes forming said side sections of said bow frame structure.

11. A retractable enclosure as claimed in claim 1 wherein said leg support assembly is comprised of a load bearing support wheel having a concave V-shape cross-section support surface for seated displacement on a convex V-shape track, and a wheel axle support bracket secured to a lower side portion of said extruded profile straight metal tubes.

12. A retractable enclosure as claimed in claim 1 wherein said metal tubes are of rectangular cross-section and each roof section and side section being formed from two or more of the extruded metal tubes interconnected together in the side-by-side relationship along the length thereof by spacer connectors formed from sections of said extruded metal tubes with said T-shaped projection of said spacer connector secured in a corresponding lower joint interconnecting channel of one of said extruded metal tube, and the interconnecting channel of said spacer connector secured to said T-shaped projection of the other extruded metal tube.

13. A retractable enclosure as claimed in claim 12 wherein said two or more of said extruded metal tubes interconnected together by said spacer connectors form a composite tube structure, there being two or more of said composite tube structures interconnected in spaced parallel relationship by rectangular metal plates having opposed profiled connecting side edges for attachment to a respective one of opposed side channels in a lower end section of opposed end ones of said extruded metal tubes of said composites tube structure whereby to form reinforced ones of said structural bow frames.

14. A retractable enclosure as claimed in claim 12 wherein said metal tubes define a central rectangular enclosed channel with open-ended channels thereabout, and a reinforcing insert positioned in close sliding fit in at least a section of said metal tubes to reinforce said metal tubes.

15. A retractable enclosure as claimed in claim 14 wherein said metal tubes are aluminum tubes.

16. A retractable enclosure as claimed in claim 1 wherein said retractable enclosure is comprised of a plurality of said displaceable structural bow frames displaceable side-by-side in parallel relationship along a straight path by said leg support assemblies, and wherein lift bow assemblies are secured to selected ones of said structural bow frames and on opposed sides thereof, said lift bow assemblies each being comprised by a bow shaped tubular member shaped to define a sloped roof section and opposed downwardly extending support side arms sections, said opposed support side arm sections being pivotally connected at a lower end to a support bracket connected to a bracket secured in a side channel of said straight metal tubes of the side sections of said bow frame, said sloped roof section extending a predetermined distance above said roof section of said structured bow frame when said opposed side arms sections extend substantially upright on their brackets.

17. A retractable enclosure as claimed in claim 16 wherein said sloped roof section of said bow shaped tubular member is formed in three sections, said three sections being pivotally interconnected on support bracket secured to truss members secured under said sloped roof section of said lift bow assemblies.

18. A retractable enclosure as claimed in claim 1 wherein said retractable enclosure is comprised of a plurality of said displaceable structural bow frames displaceable side-by-side along a straight path by said leg support assemblies, and wherein there is further provided a pantograph frame interconnecting adjacent ones of said side sections of said displaceable structural bow frames, said pantograph frame comprising a pair of rod-like members pivotally connected to one another at a central crossing point, a lower end of each said pair of rod-like members being pivotally secured to a stationary support bracket secured in a connection channel of said side section of said adjacent ones of said displaceable structural bow frame, and an upper end of each said pair of rod-like members being displaceably connected to a sliding support bracket slidingly retained captive in said connecting channel of said adjacent ones of said displaceable structural bow frames.

19. A retractable enclosure as claimed in claim 1 wherein said retractable enclosure is comprised of a plurality of said displaceable structural bow frames displaceable side-by-side along a straight path by said leg support assemblies, said retractable enclosure being comprised by two or more of a plurality of said displaceable structural bow frames which form shell units, an interconnecting end frame structure being provided in each said shell units to interconnect shell units together, said interconnecting end frame structure being formed by two of said displaceable structural bow frames interconnected together in close spaced-apart relationship by spacer connectors, and shell units interconnection means to connect and disconnect said shell units from one another.

20. A retractable enclosure as claimed in claim 19 wherein said shell units interconnection means is comprised by a slide connector displaceably secured to each said metal tubes forming said roof section and opposed upwardly extending side sections, said slide connectors each having attachment legs displaceably secured in said connecting channels of said interconnecting end frame structure, a guided tether interconnecting said slide connectors together, actuating means to displace said slide connectors in unison, said actuating means having a locking mechanism, and engageable elements immovably secured to the other of said opposed interconnecting end frames of an adjacent shell unit at predetermined locations for engagement by respective ones of said slide connectors.

21. A retractable enclosure as claimed in claim 20 wherein said slide connectors are sliding plate connectors having a retracting notch therein, said retracting notch having an outer projection with a sloped inner edge to capture said engageable element and retract same in said notch to pull said opposed interconnecting end frame of said adjacent shell unit to interlock said adjacent shell units together in tight fit.

22. A retractable enclosure as claimed in claim 21 wherein an end one of said slide connectors is slidingly secured to one of said metal tube of said opposed upwardly extending side sections, and a retracting spring means secured to said end one of said slide connectors whereby to apply a pulling force on said interconnected slide connectors to position all of said slide connectors at a disengaged position.

23. A retractable enclosure as claimed in claim 22 wherein the other end one of said slide connectors is slidingly secured to the extruded straight metal tubes of the other of said opposed upwardly extending side sections, and a strap secured thereto and to said actuating means.

24. A retractable enclosure as claimed in claim 23 wherein said actuating means is a tensioner device about which said strap is wound and unwound, said tensioner device having an actuating means to exert a pulling force on said strap to displace all of said slide connectors in unison and to an engaged position, and means to unlock said locking mechanism of said ratchet to release said sliding plates to their said disengaged position by the pulling force of said retracting spring means.

25. A retractable enclosure as claimed in claim 20 wherein gasket elements are secured in connecting channel of an outer side wall of said metal tubes of one of said interconnecting end frames.

26. A retractable enclosure as claimed in claim 1 wherein said retractable enclosure is comprised of a plurality of said displaceable structural bow frames displaceable side-by-side along a straight path by said leg support assemblies, and wherein end ones of said bow frame structures are formed by two of said displaceable structural frame structures interconnected together in close spaced-apart relationship by spacer connectors, and a brace arm pivotally connected at one end to a vertical slide connector having attachment legs displaceably secured in said connecting channels of said two structural bow frames interconnected together, the other end of said brace arm having an arresting formation to engage in a bracket secured to a stationary member to a side of said retractable enclosure adjacent the opposed ends thereof, and actuating means to impart downward displacement of said vertical slide connector to cause pivotal downward displacement of said brace arm to apply a pushing force against said end bow frame towards an end of said retractable enclosure to pull of said bow frames and tension the tarp sections between said plurality of said bow frames intermediate opposed end frames of said retractable enclosure.

27. A retractable enclosure as claimed in claim 26 wherein said vertical slide connector has a strap connected to a lower end thereof, said strap being secured to a ratchet constituting said actuating means, said ratchet having a strap tensioning and release mechanism to permit upward displacement of said vertical slide plate to position said brace arm to a stored vertical position against said two structural frame structures interconnected together.

28. A retractable enclosure as claimed in claim 26 wherein at least one of said end ones of said bow frame structures has a door for access to the interior of said retractable enclosure.

29. A retractable enclosure as claimed in claim 1 wherein said retractable enclosure is comprised of a plurality of said displaceable structural bow frames displaceable side-by-side along a straight path by said leg support assembly, said tarp being interconnected along opposed flexible rod-like enlarged edges thereof to tarp connecting channels of said metal tubes of selected ones of said structural bow frames, and wherein said tarp further comprises a wear resistant fin skirt along a lower end portion of said tarp and angled adjacent a support rail on which is displaced a load support wheel of said leg support assembly to substantially prevent air flow in and out of said retractable enclosure, said fin skirt extending between adjacent ones of said plurality of said displaceable structural bow frames.

30. A retractable enclosure as claimed in claim 29 wherein there is further provided a flexible rod secured to an inner surface said tarp spaced above said fin skirt, said flexible rod having a memory bend to push said tarp outwards between said adjacent ones of said plurality of said displaceable structural bow frames.

31. A retractable enclosure as claimed in claim 29 wherein there is further provided on said inner surface of said tarp a condensation wicking fin secured spaced above said fin skirt to collect condensation forming on said inner surface and direct it inwardly of said support rail to prevent water from freezing on said support rail.

32. A retractable enclosure as claimed in claim 29 wherein there is further provided snow/ice removal devices secured to carriages displaceably secured to connecting channels of intermediate structural bow frame structure above which spans an unattached section of said tarp to impart a vertical displacement to said unattached section to break and dislodge ice or packed snow that may have formed thereon, and guided tether means to displace said carriages.

* * * * *